US007286151B2

(12) United States Patent
Sawai

(10) Patent No.: US 7,286,151 B2
(45) Date of Patent: Oct. 23, 2007

(54) IMAGE FORMING APPARATUS AND THERMAL TRANSFER PRINTER

(75) Inventor: Kunio Sawai, Daito (JP)

(73) Assignee: Funai Electric Co., Ltd., Osaka (JP)

( * ) Notice: Subject to any disclaimer, the term of this patent is extended or adjusted under 35 U.S.C. 154(b) by 248 days.

(21) Appl. No.: 11/090,041

(22) Filed: Mar. 28, 2005

(65) Prior Publication Data

US 2005/0225625 A1 Oct. 13, 2005

(30) Foreign Application Priority Data

Apr. 13, 2004 (JP) ..... 2004-117988

(51) Int. Cl.
*B41J 25/304* (2006.01)

(52) U.S. Cl. ..... 347/197; 400/120.16

(58) Field of Classification Search ..... 347/197, 347/198; 400/120.16, 120.17
See application file for complete search history.

(56) References Cited

U.S. PATENT DOCUMENTS 7,073,962 B2 * 7/2006 Sawai ..... 400/120.01
7,081,911 B2 * 7/2006 Sawai ..... 347/197

FOREIGN PATENT DOCUMENTS

JP 05-085012 A 4/1993

* cited by examiner

*Primary Examiner*—Huan Tran
(74) *Attorney, Agent, or Firm*—Global IP Counselors, LLP

(57) ABSTRACT

The image forming apparatus has a frame, a head portion pivotably supported on the frame, a platen roller supported on the frame opposite the head portion, an elastic support rod supported on the frame, a rotary member pivotably supported by the support rod and having a pressing member, and a drive mechanism engaged with the rotary member to pivot the rotary member around the support rod. The pressing member presses the head portion against the platen roller with the urging force of the support rod. The image forming apparatus is structured with members that are easy to manufacture.

13 Claims, 23 Drawing Sheets

PRIOR ART

IMAGE FORMING APPARATUS AND THERMAL TRANSFER PRINTER

BACKGROUND OF THE INVENTION

1. Field of the Invention

The present invention relates to an image forming apparatus and a thermal transfer printer. More specifically, the present invention relates to an image forming apparatus and a thermal transfer printer equipped with a printing head for performing printing.

2. Background Information

An image forming apparatus equipped with a thermal head or other such printing head has been known. For example, Japanese Patent Application Publication 5-85012 discloses such arrangement.

Japanese Patent Application Publication 5-85012 discloses a head pressing apparatus for a thermal printer, which includes a torsion bar having ends that are bent at right angles in opposite directions. The torsion bar is disposed at the top of a thermal head, and the bent ends of the torsion bar are pressed during printing. Therefore, the pressing forces applied to the bent ends of the torsion bar are transmitted to the thermal head in a balanced manner through the torsion bar, which suppresses the difference in the pressing force in the width direction of the thermal head.

Also, thermal transfer printers are known as a type of image forming apparatus. FIGS. 40 and 41 are oblique views of the overall structure of a conventional thermal transfer printer. FIGS. 42 and 43 are oblique views illustrating the attachment structure of a pressing member and a shaft. FIG. 44 is a cross section illustrating the pressing operation of the thermal head on the platen roller in the conventional thermal transfer printer shown in FIGS. 40 and 41. The structure of a conventional thermal transfer printer will now be described through reference to FIGS. 40 to 44.

As shown in FIGS. 40 and 41, this conventional thermal transfer printer includes a metal frame 101, a thermal head 102 for performing printing, a platen roller 103, platen roller bearings 104 that rotatably support the platen roller 103, a metal shaft 105, pressing members 106 and 107, a drive gear 108 having a small-diameter gear 108*a* and a large-diameter gear 108*b*, both made of resin, for pivoting the pressing member 106, a torsion coil spring 109, a motor 110, a motor bracket 111, and an intermediate gear 112.

Also, as shown in FIGS. 40 and 41, an ink sheet insertion portion 101*c* for attaching an ink sheet (not shown) is provided to a second surface 101*b*, which is located opposite a first surface 101*a* of the frame 101 to which the motor bracket 111 is attached. Insertion holes 101*d* into which the ends of the shaft 105 are rotatably inserted are provided in the first surface 101*a* and the second surface 101*b* of the frame 101. The thermal head 102 is attached so as to be pivotable around a support shaft 102*a* on the inside of the two side surfaces of the frame 101. The torsion coil spring 109 is attached to the support shaft 102*a* of the thermal head 102. The function of this torsion coil spring 109 is to urge the thermal head 102 away from the platen roller 103. Also, a head component 102*b* provided to the lower part of the thermal head 102 is disposed opposite the platen roller 103. Bent components 102*c* that are pressed on by the pressing members 106 and 107 are formed above the ends of the head component 102*b* of the thermal head 102.

As shown in FIGS. 42 and 43, insertion parts 105*a* are formed near the ends of the shaft 105 in a flat-sided oval shape, and are non-rotatably inserted in flat-sided oval-shaped insertion holes 106*a* and 107*a* of the pressing members 106 and 107. Bearing supports 105*b* are formed at the ends of the insertion parts 105*a* of the shaft 105. The bearing supports 105*b* are rotatably supported in insertion holes 101*d* of the frame 101. Pressing springs 106*b* and 107*b* that press on the bent components 102*c* of the thermal head 102 are attached to the pressing members 106 and 107, respectively. As shown in FIG. 40, the pressing member 106 is disposed so as to engage with the small-diameter gear 108*a* of the drive gear 108. The drive gear 108 is attached to the first surface 101*a* of the frame 101, and transmits drive force from the intermediate gear 112 to the pressing member 106. The drive force of the motor 110 (see FIG. 41) attached to the motor bracket 111 is transmitted through the intermediate gear 112 (see FIG. 44) to the large-diameter gear 108*b* of the drive gear 108, then to the small-diameter gear 108*a* to the pressing member 106.

FIGS. 40 and 41 show how the thermal head 102 presses on the platen roller 103 with the above-mentioned conventional thermal transfer printer. The drive force of the motor 110 is transmitted through the intermediate gear 112 and the large-diameter gear 108*b* and the small-diameter gear 108*a* of the drive gear 108 to the pressing member 106, which causes the pressing member 106 to pivot while being supported in the insertion holes 101*d* of the frame 101. As a result, the pressing spring 106*b* of the pressing member 106 presses on the bent component 102*c* on the first surface 101*a* side of the frame 101. Since the pressing members 106 and 107 are non-rotatably attached to the shaft 105, pivoting of the pressing member 106 causes the shaft 105 and the pressing member 107 to pivot as well. As a result, the pressing spring 107*b* of the pressing member 107 presses on the bent component 102*c* on the second surface 101*b* side of the frame 101. Consequently, the head component 102*b* of the thermal head 102 is pressed against the platen roller 103 against the biasing force of the torsion coil spring 109.

In the conventional thermal transfer printer shown in FIGS. 40 to 44, the insertion portions 105*a* at the ends of the shaft 105 are formed in a flat-sided oval shape in order to non-rotatably link the shaft 105 and the pressing members 106 and 107, which are the components that press on the thermal head 102. Obtaining such oval shape requires a time-consuming cutting procedure. Furthermore, since the shaft diameter of the bearing supports 105*b* at the ends of the insertion parts 105*a* has to be made smaller than the width of the flat-sided portion of the insertion portions 105*a*, it is also necessary to perform a cutting procedure on the insertion portions 105*a*. Therefore, it takes a long time to manufacture the insertion portions 105*a*.

In view of the above, it will be apparent to those skilled in the art from this disclosure that there exists a need for improved thermal transfer printers and image forming apparatuses that overcome the problems of the conventional art. This invention addresses this need in the art as well as other needs, which will become apparent to those skilled in the art from this disclosure.

SUMMARY OF THE INVENTION

The present invention was conceived in order to solve the above problem, and it is the first object of the present invention to provide a thermal transfer printer and an image forming apparatus for which it takes less time to manufacture the member used for pressing the printing head portion.

The image forming apparatus according to a first aspect of the present invention includes a frame, a head portion pivotably supported on the frame, a platen roller supported on the frame opposite the head portion, an elastically deformable support rod supported on the frame, a rotary member pivotably supported by the support rod and having a pressing member, the pressing member being adapted to press the head portion against the platen roller with an urging force of the support rod, and a drive mechanism engaged with the rotary member to pivot the rotary member around the support rod.

In this image forming apparatus, by using the rotary member that is pivotably supported by the support rod, it is no longer necessary to form a structure in which the rotary member and the support rod are unrotatably coupled. Therefore, manufacturing of the image forming apparatus can be simplified.

Preferably, in the image forming apparatus, the pressing member is positioned between the support rod and the head portion when the pressing member presses the head portion against the platen roller with the urging force of the support rod.

In this image forming apparatus, since the pressing member is positioned between the support rod and the head portion, the reaction force from the head portion does not pivot the pressing member. Therefore, it is possible to keep the pressing force that is applied to the head portion constant. Thus, it is possible to perform more consistent printing more easily.

Preferably, in the image forming apparatus, the pressing member has a flat bottom surface that comes into contact with the head portion.

In this image forming apparatus, by using the pressing member that has a flat bottom surface, it is possible to prevent pivoting of the pressing member while the pressing member presses on the head portion.

Preferably, in the image forming apparatus, the drive mechanism has a drive gear, and the rotary member has a toothed portion that engages with the drive gear.

Alternatively, in the image forming apparatus, the drive mechanism has a cam groove, and the rotary member has a cam pin that engages with the cam groove.

Preferably, in the image forming apparatus, the pressing member presses the head portion at substantially a width direction center of the head portion.

In this manner, it is possible to press on the head portion with a consistent pressing force in the width direction.

Preferably, in the image forming apparatus, the rotary member includes a first side arm that engages the drive mechanism and a second side arm to which the pressing member is attached, each of the first and second side arms being rotatably supported by the support rod.

In this structure, since both the first and second side arms are pivotably supported by the support rod, the first and second side arms do not rotate relative to one another. Therefore, there is no need to create a separate structure to prevent relative rotation between the first and second side arms.

Preferably, in the image forming apparatus, the support rod is made of a piano wire.

A thermal transfer printer according to a second aspect of the present invention includes a frame, a thermal head pivotably supported on the frame and adapted to perform printing, a platen roller supported on the frame opposite the thermal head, an elastically deformable metal support rod supported on the frame, a rotary member pivotably supported by the support rod and having first and second side arms and a pressing member that is attached to the second side arm and has a flat bottom surface, each of the first and second side arms being rotatably supported by the support rod, a drive mechanism engaged with the first side arm of the rotary member to pivot the second side arm around the support rod. A first distance between the flat bottom surface of the pressing member and where the support rod supports the second side arm is longer than a second distance between where the support rod is supported on the frame and an upper surface of the thermal head when the thermal head is pivoted toward the platen roller the most.

In this thermal transfer printer, since both the first and second side arms are pivotably supported by the support rod, the first and second side arms do not rotate relative to one another. Therefore, there is no need to create a separate structure to prevent relative rotation between the first and second side arms. Therefore, manufacturing of the thermal transfer printer can be simplified. Also in this thermal transfer printer, by using the pressing member that has a flat bottom surface, it is possible to prevent pivoting of the pressing member while the pressing member presses on the thermal head.

Preferably, in the thermal transfer printer, the drive mechanism has a drive gear, and the first side arm of the rotary member has a toothed portion that engages with the drive gear.

Alternatively, in the thermal transfer printer, the drive mechanism includes a cam groove, and the first side arm of the rotary member has a cam pin that engages with the cam groove.

Preferably, in the thermal transfer printer, the pressing member presses the thermal head at substantially a width direction center of the thermal head.

In this manner, it is possible to press on the thermal head with a consistent pressing force in the width direction.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

First Embodiment

Figure 1:
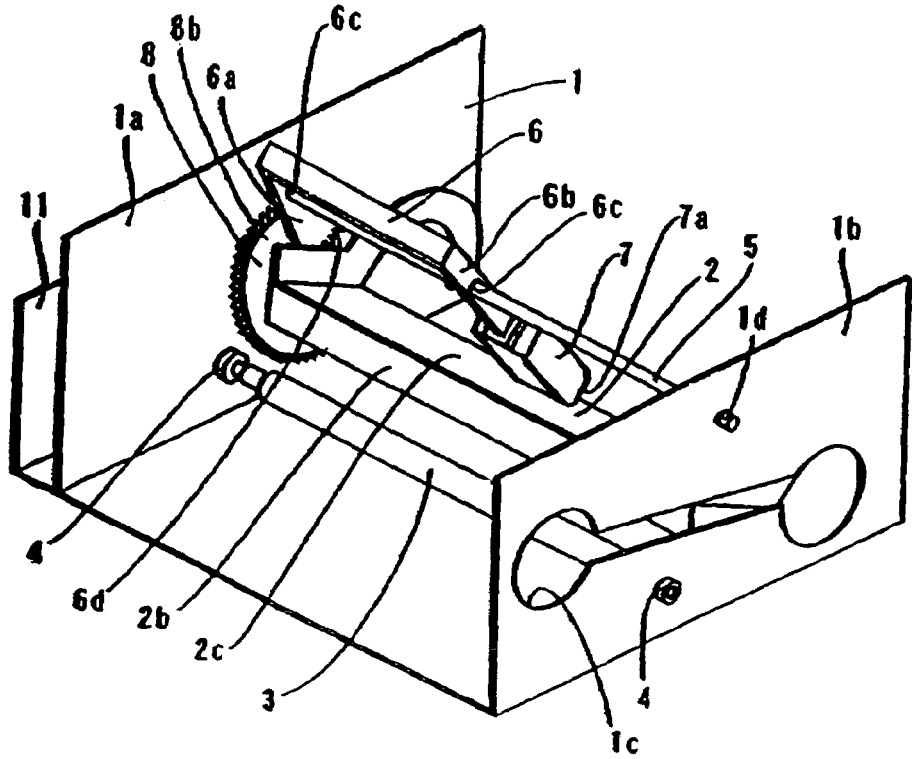
FIG. 1 is an oblique view of the overall structure of the thermal transfer printer in accordance with the first embodiment of the present invention.
Figure 2:
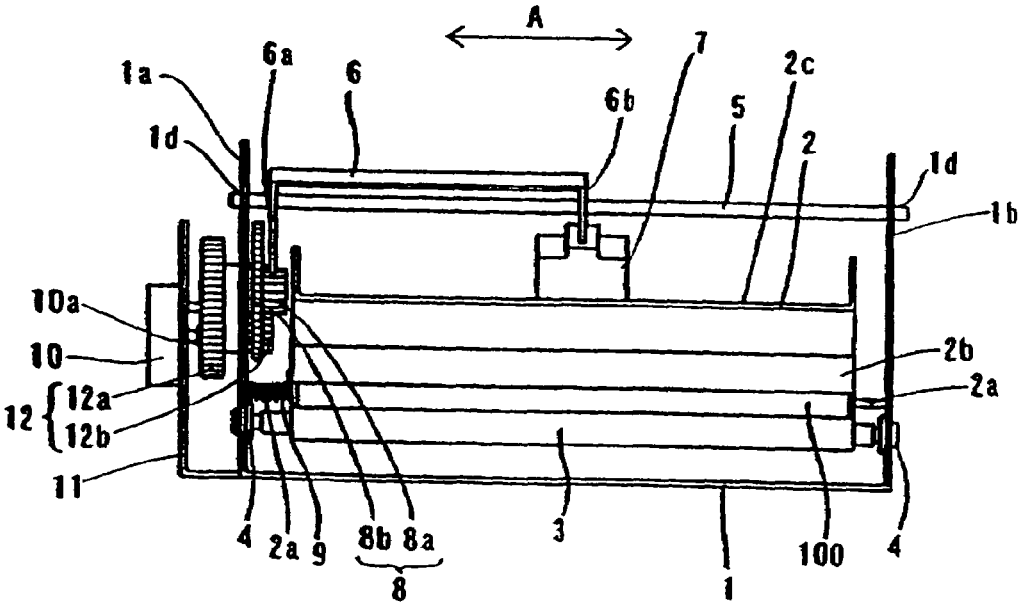
FIG. 2 is a front view of the thermal transfer printer in accordance with the first embodiment.

FIG. 1 is an oblique view of the overall structure of the thermal transfer printer in accordance with the first embodiment of the present invention. FIG. 2 is a front view of the thermal transfer printer in accordance with the first embodiment shown in FIG. 1. FIGS. 3 to 6 are diagrams of the detailed structure of the thermal transfer printer in accordance with the first embodiment shown in FIG. 1. FIGS. 7 to 10 are diagrams illustrating how the thermal head presses on the platen roller in the thermal transfer printer shown in FIG. 1 in accordance with the first embodiment.

First, the structure of the thermal transfer printer in accordance with the first embodiment of the present invention will be described through reference to FIGS. 1 to 6.

As shown in FIGS. 1 and 2, the thermal transfer printer pertaining to the first embodiment includes a metal frame 1; a thermal head 2 pivotably supported on the frame 1 for performing printing; a platen roller 3 rotatably supported on the frame 1; a platen roller bearing 4 for rotatably supporting the platen roller 3; an elastically bendable support rod 5 which is a piano wire with a diameter of approximately 3 mm; a metal rotary member 6; a resin pressing member 7; a resin drive gear 8 having a small-diameter gear 8*a* and a large-diameter gear 8*b* for pivoting the rotary member 6; a torsion coil spring 9; a motor 10 having a motor shaft gear 10*a*; a metal motor bracket 11; and an intermediate gear 12 having a large-diameter gear 12*a* that engages with the motor shaft gear 10*a*, and a small-diameter gear 12*b* that engages with the large-diameter gear 8*b* of the drive gear 8. This thermal transfer printer is an example of the "image forming apparatus" of the present invention, and the thermal head 2 is an example of the "printing head" or "head portion" of the present invention. The drive gear 8 is an example of the "drive mechanism" of the present invention.

As shown in FIGS. 1 and 2, an ink sheet insertion portion 1*c* where ink sheets (not shown) are to be inserted is provided to a second surface 1*b* of the frame 1, which is located opposite from a first surface 1*a* of the frame 1 to which the motor bracket 11 is attached. Insertion holes 1*d* into which the ends of the support rod 5 are rotatably inserted are provided on the first surface 1*a* and the second surface 1*b* of the frame 1. The thermal head 2 is attached so as to be pivotable around a support shaft 2*a* on the inside of the two side surfaces of the frame 1. The torsion coil spring 9 is attached to the support shaft 2*a* of the thermal head 2. The torsion coil spring 9 is provided diagonally in the first surface 1*a* to bias the thermal head 2 away from the platen roller 3. As a result, when the pressing member 7 is not pressing on the thermal head 2, there is a gap 100 (see FIG. 2) between the lower part of the head portion 2*b* of the thermal head 2 and the upper part of the platen roller 3. The head portion 2*b* of the thermal head 2 is provided to the lower part of the thermal head 102 so as to be disposed opposite the platen roller 3.

Figure 3:
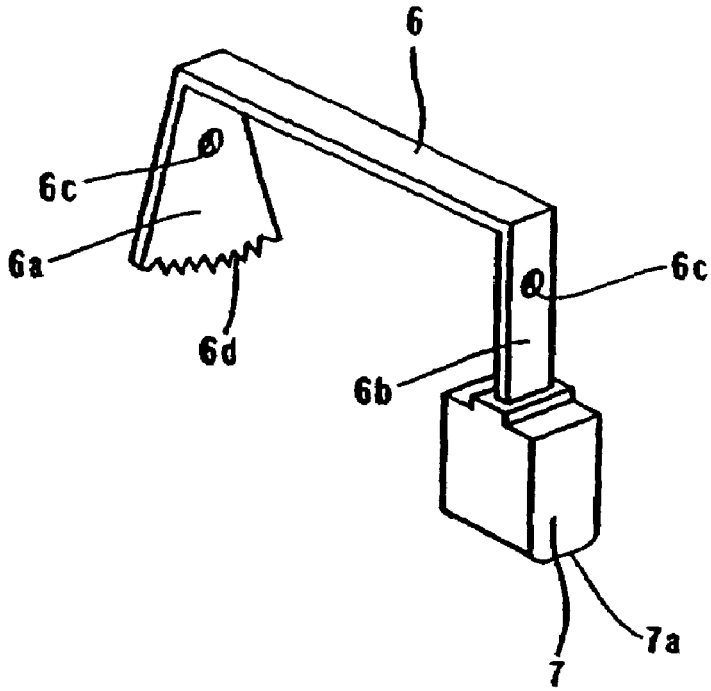
FIG. 3 is an oblique view of the structure of the rotary member of the thermal transfer printer in accordance with the first embodiment.
Figure 4:
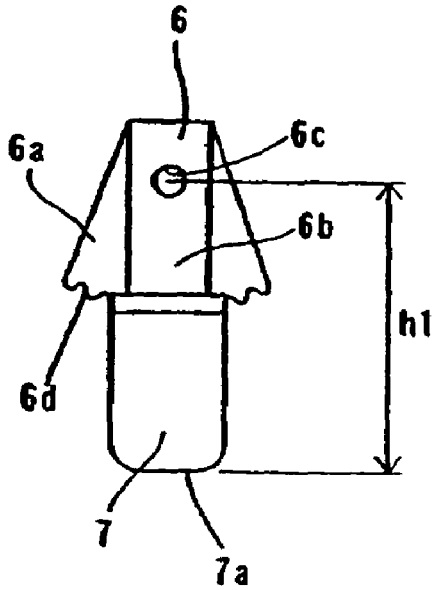
FIG. 4 is a front view of the structure of the rotary member of the thermal transfer printer in accordance with the first embodiment.
Figure 5:
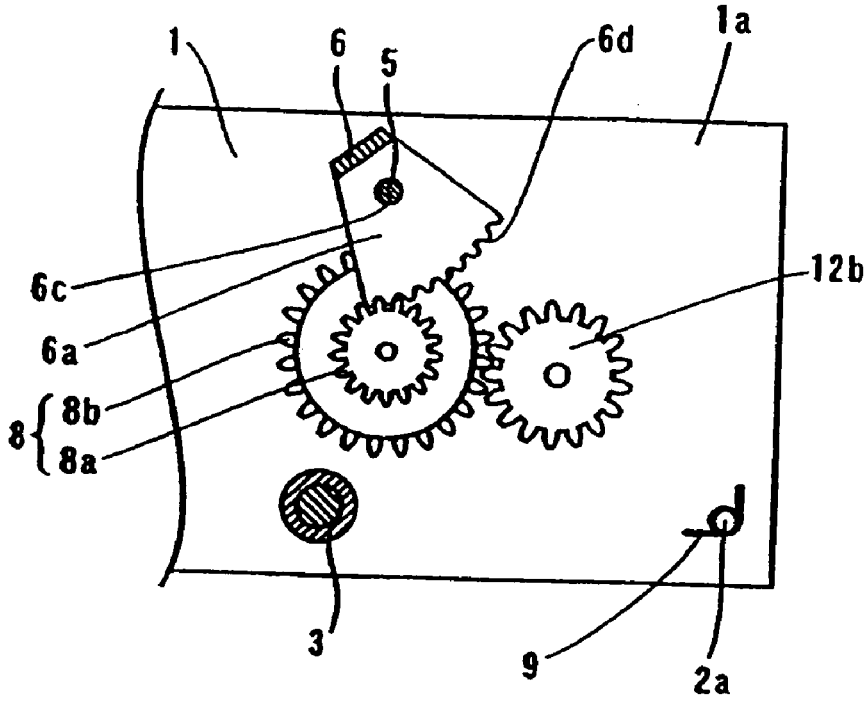
FIG. 5 is a schematic view of the attachment structure of the rotary member and drive gear of the thermal transfer printer in accordance with the first embodiment.
Figure 6:
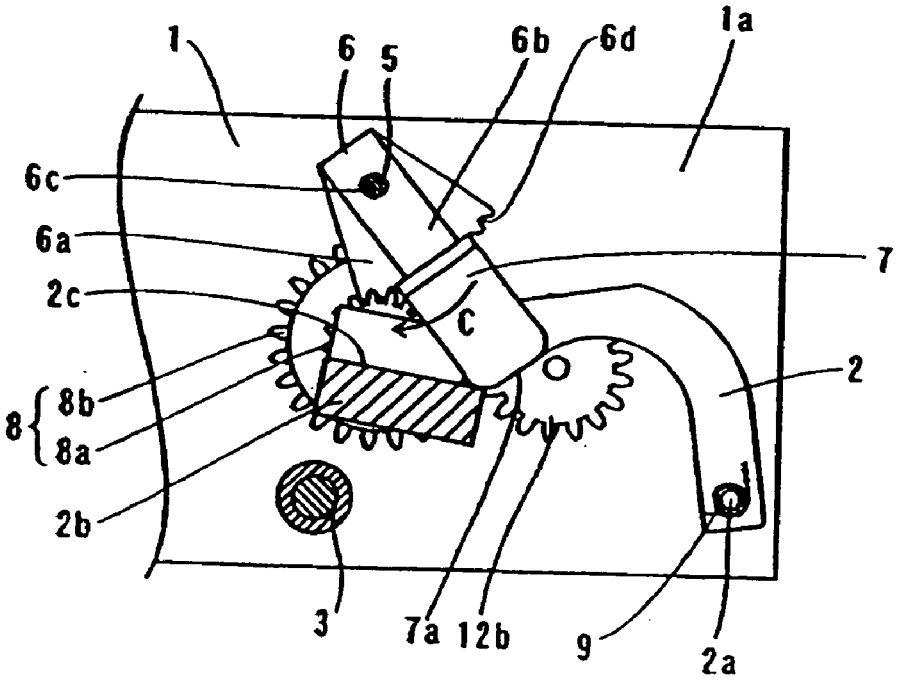
FIG. 6 is a schematic view of the positional relationship between the thermal head and the rotary member of the thermal transfer printer in accordance with the first embodiment, when the thermal head is away from the platen roller.
Figure 7:
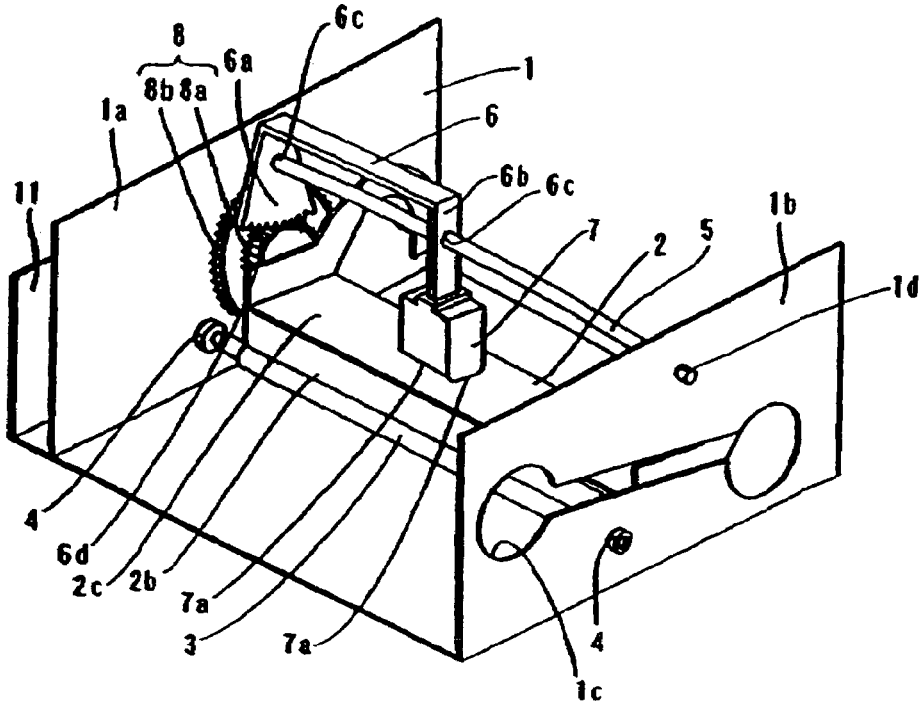
FIG. 7 is an oblique view of the overall structure of the thermal transfer printer in accordance with the first embodiment, when the rotary member is pressing against the thermal head.

In this first embodiment, the ends of the bendable support rod 5 are rotatably inserted into insertion holes 1*d* on the first surface 1*a* and the second surface 1*b* of the frame 1. As shown in FIG. 3, the rotary member 6 is formed in a square shape with a first side surface 6*a* and a second side surface 6*b* to which the resin pressing member 7 is attached. Holes 6*c* for attaching the support rod 5 are provided in the first side surface 6*a* and the second side surface 6*b* of the rotary member 6. A toothed portion 6*d* is provided to the first side surface 6*a* of the rotary member 6 as seen in FIG. 3. As shown in FIGS. 5 and 6, this toothed portion 6*d* is disposed so as to engage with the drive gear 8 attached to the first surface 1*a* of the frame 1. The above-mentioned resin pressing member 7 is attached to the second side surface 6*b* of the metal rotary member 6. As shown in FIGS. 2-4, the pressing member 7 has a square shape with a flat bottom pressing surface 7*a* having rounded corners. Also, the pressing member 7 is disposed such that through its pivoting the pressing member 7 presses the thermal head 2 at near its width direction center (the direction of arrow A in FIG. 2).

Also, in this first embodiment, as shown in FIG. 4, part of the pressing surface 7*a* at the tip of the pressing member 7 is formed flat, so that the pressing member 7, which is attached to the second side surface 6*b* of the rotary member 6, comes into planar contact with the top surface 2*c* of the thermal head 2 in the course of pressing on the thermal head 2. The pressing member 7 is also disposed so that when the pressing member 7 presses the thermal head 2, the contact position between the pressing member 7 and the thermal head 2 is substantially directly beneath the support rod 5. In other words, when the pressing member 7 presses the thermal head 2, the pressing member 7 is between the support rod 5 and the thermal head 2. Furthermore, the supporting rod 5 is designed to elastically bend upward when the pressing member 7 presses the thermal head 2. The height h1 (an example of the first distance, shown in FIG. 4) from the pressing surface 7*a* of the pressing member 7 to the center of the hole 6*c* in the second side surface 6*b* of the rotary member 6 is set to be approximately 3 mm greater than the height h2 (an example of the second distance, shown in FIG. 8), which is the distance between the top surface 2*c* of the thermal head 2 and the center of the insertion holes 1*d* in the frame 1. Therefore, the support rod 5 is bent upward approximately 3 mm while the pressing member 7 presses on the thermal head 2.

As shown in FIG. 5, the drive gear 8 is attached to the first surface 1*a* of the frame 1 and transmits drive force from the intermediate gear 12 to the rotary member 6. The drive force of the motor 10 (see FIG. 2) that is attached to the motor bracket 11 is transmitted from the motor shaft gear 10*a*, through the large-diameter gear 12*a* and the small-diameter gear 12*b* of the intermediate gear 12, to the large-diameter gear 8*b* of the drive gear 8.

Figure 8:
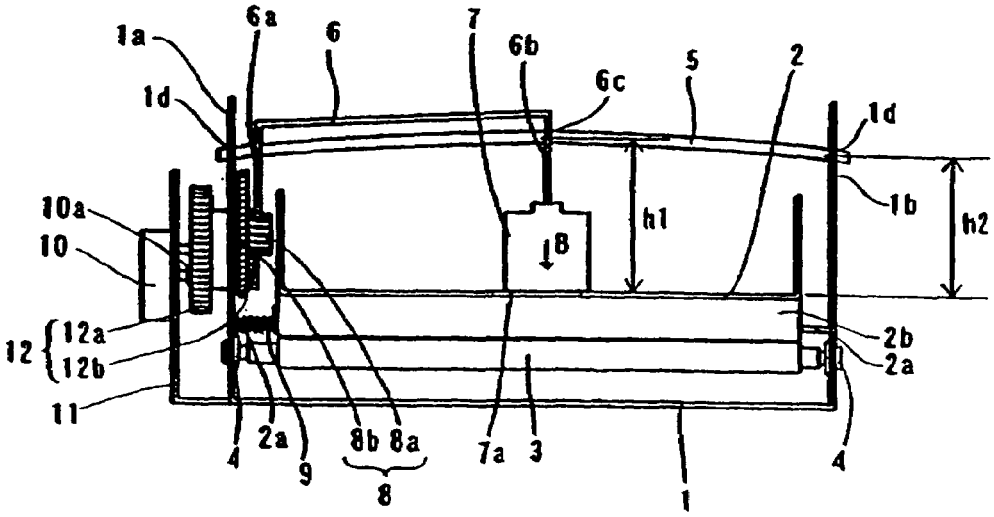
FIG. 8 is a front view of the thermal transfer printer in accordance with the first embodiment, when the rotary member is pressing against the thermal head.
Figure 9:
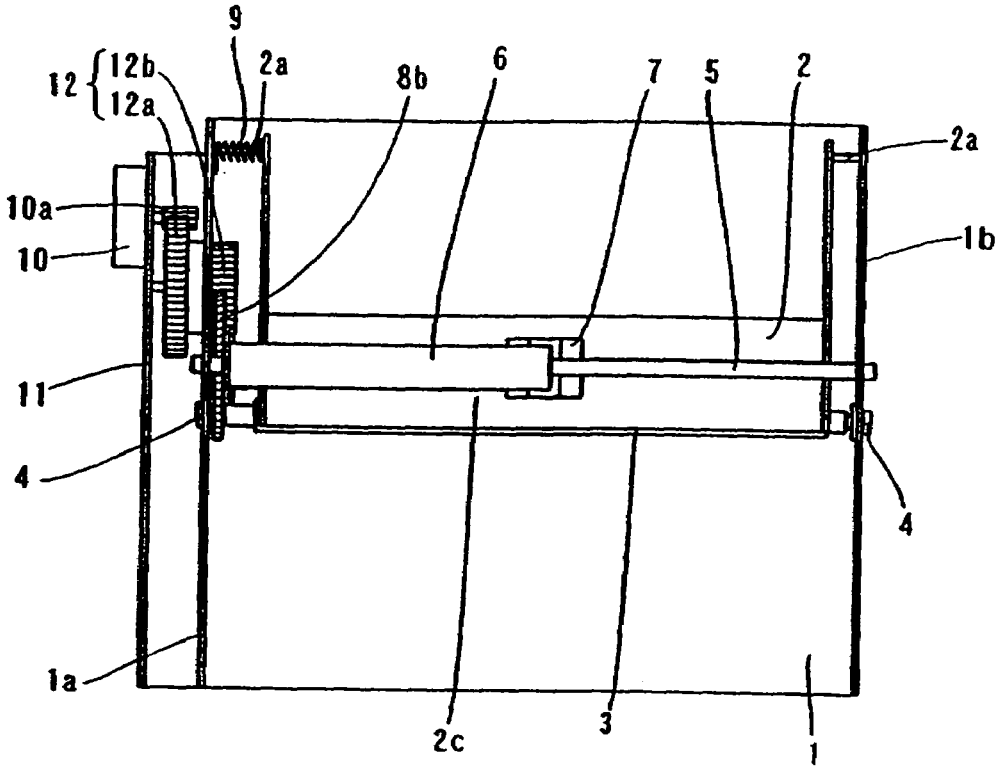
FIG. 9 is a plan view of the thermal transfer printer in accordance with the first embodiment, when the rotary member is pressing against the thermal head.
Figure 10:
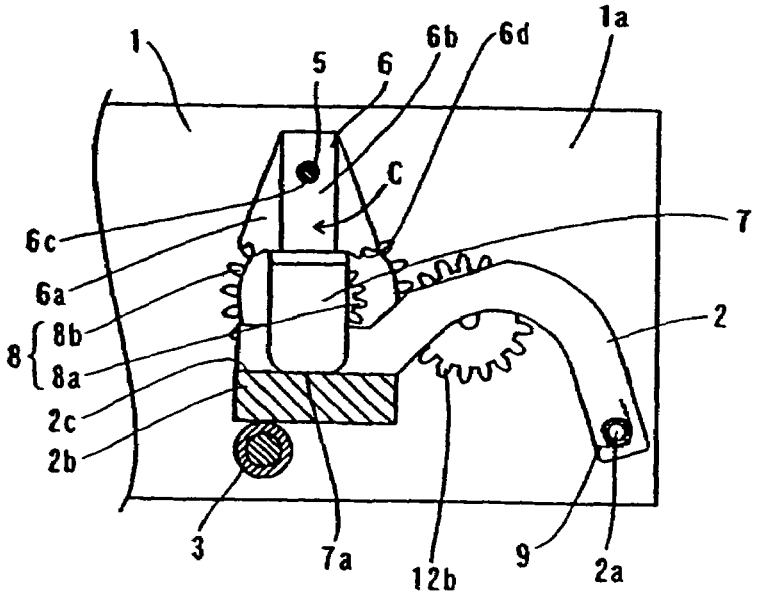
FIG. 10 is a schematic view of the positional relationship between the thermal head and the rotary member in accordance with the first embodiment, when the rotary member is pressing against the thermal head.

Next, the manner in which the thermal head 2 presses on the platen roller 3 in the thermal transfer printer of this first embodiment will be described with reference to FIGS. 1 through 10. First, in the initial state, as shown in FIGS. 1 through 6, the biasing force of the torsion coil spring 9 causes the thermal head 2 to pivot away from the platen roller 3, and the rotary member 6 stays in a pivoted position where the pressing member 7 does not press on the thermal head 2. In this state, the drive force of the motor 10 (see FIG. 2) is transmitted from the motor shaft gear 10*a*, through the large-diameter gear 12*a* and small-diameter gear 12*b* of the intermediate gear 12 and the large-diameter gear 8*b* and small-diameter gear 8*a* of the drive gear 8, to the first side surface 6*a* of the rotary member 6. As a result, the first side surface 6*a* of the rotary member 6 pivots from the state shown in FIG. 1 to the state shown in FIG. 7 in the direction of arrow C in FIG. 6, so the second side surface 6*b* of the rotary member 6 is pivoted accordingly, changing from the state shown in FIG. 6 to the state shown in FIG. 10. Consequently, the pressing surface 7*a* of the pressing member 7 attached to the second side surface 6*b* of the rotary member 6 strikes the top surface 2*c* of the thermal head 2 as shown in FIGS. 8 and 10. At this point, the pressing member 7 is positioned between the support rod 5 and the top surface 2*c* of the thermal head 2 as shown in FIG. 8, and the height h1, which is the distance between the pressing surface 7*a* of the pressing member 7 and the center of the hole 6*c* in the second side surface 6*b* of the rotary member 6, is set to be approximately 3 mm greater than the height h2, which is the distance between the top surface 2*c* of the thermal head 2 during pressing operation and the center of the insertion holes 1*d* in the frame 1. Thus, the support rod 5, which is made of a piano wire with a diameter of approximately 3 mm, is elastically bent upward by approximately 3 mm. This generates flexural stress of about 30 to 40 N in the support rod 5, and this flexural stress causes the pressing surface 7*a* of the pressing member 7 to press against the top surface 2*c* of the thermal head 2 in the direction of arrow B shown in FIG. 8. As a result, the head portion 2*b* of the thermal head 2 is pressed against the platen roller 3 at a pressing force of approximately 30 to 40 N.

As discussed above, in the first embodiment, there are provided the bendable support rod 5 and an open-box-shaped rotary member 6 that is attached to the support rod 5 and includes the first side surface 6*a* that engages with the drive gear 8 and the second side surface 6*b* that has the pressing member 7. The pressing member 7 of the second side surface 6*b* of the rotary member 6 uses pressing force produced by the bending of the support rod 5 to press the thermal head 2 against the platen roller 3. In this manner, the requisite pressing force during the printing operation can be generated by the support rod 5 and the open-box-shaped rotary member 6, by utilizing the biasing force of the bendable support rod 5.

Also, in the first embodiment, the open-box-shaped rotary member 6 includes the first side surface 6*a*, which the drive gear 8 rotates, and the second side surface 6*b*, which has the pressing member 7. Therefore, there is no relative rotation between the first side surface 6*a* and second side surface 6*b*, since they are formed unitarily as the one-piece rotary member 6. Accordingly, there is no need to make a D-cut or flat-sided oval shape in order to prevent spinning between the first and second side surfaces 6*a* and 6*b*. In other words, the rotary member 6 can be formed by press forming, which takes only a short time, without having to perform any time-consuming cutting operations. Thus, in an image forming apparatus having a mechanism that uses the rotary member 6 to press on the thermal head 2, it is possible to reduce the time required to manufacture the rotary member 6, which is the member for pressing on the thermal head 2.

Also, in the first embodiment, the pressing member 7 of the second side surface 6*b* of the rotary member 6 is disposed such that the contact position between the thermal head 2 and the pressing member 7 comes substantially directly beneath the support rod 5 during the pressing operation of the thermal head 2. In this manner, even when a reaction force is imparted straight upward from the thermal head 2 to the pressing member 7 in the course of pressing on the thermal head 2, the reaction force does not cause the second side surface 6*b* of the rotary member 6 to pivot. Therefore, it is possible to reduce the unevenness in printing since the pressing force applied to the thermal head can be kept constant.

Also, in the first embodiment, since part of the pressing member 7 that is in contact with the thermal head 2 is formed as a flat surface, the pressing member 7 is less likely to pivot relative to the thermal head 2 during the pressing operation than the case where the pressing surface 7*a* of the pressing member 7 is formed in a merely curved shape. In this manner, the unevenness in printing can be reduced, since the pressing force applied to the thermal head 2 can better be kept constant.

Also, in the first embodiment, since the toothed portion 6*d* that engages with the drive gear 8 is provided to the first side surface 6*a* of the rotary member 6, the drive force of the drive gear 8 can be transmitted to the rotary member 6 merely by engaging the drive gear 8 with the toothed portion 6*d* of the first side surface 6*a* of the rotary member 6. Thus, the pressing member 7 that is attached to the second side surface 6*b* of the rotary member 6 can be easily pivoted.

Also, in the first embodiment, since the pressing member 7 that is attached to the second side surface 6*b* of the rotary member 6 is disposed so as to press on the thermal head 2 at around the center in the width direction, the thermal head 2 can be pressed more uniformly in the width direction (direction A in FIG. 2) of the thermal head 2. Therefore, the thermal head 2 can be brought into contact with the platen roller 3 more uniformly, and the unevenness in printing can be further reduced.

Second Embodiment

Referring now to FIGS. 11-21, a thermal transfer printer in accordance with a second embodiment will now be explained. In view of the similarity between the first and second embodiments, the parts of the second embodiment that are identical to the parts of the first embodiment will be given the same reference numerals as the parts of the first embodiment. Moreover, the descriptions of the parts of the second embodiment that are identical to the parts of the first embodiment may be omitted for the sake of brevity.

Figure 11:
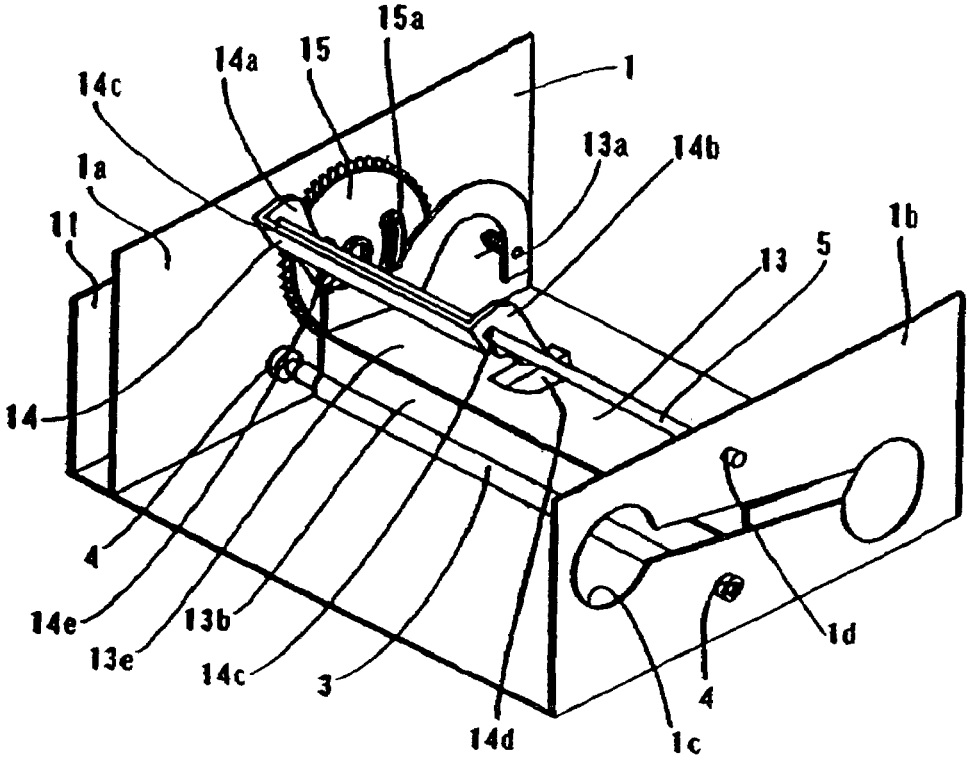
FIG. 11 is an oblique view of the overall structure of the thermal transfer printer in accordance with the second embodiment of the present invention.
Figure 12:
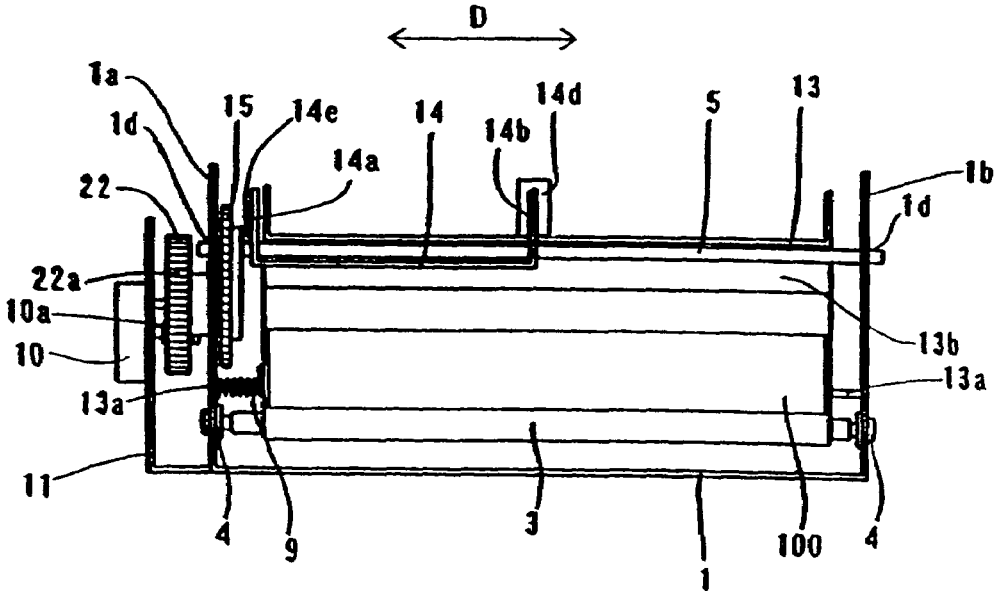
FIG. 12 is a front view of the thermal transfer printer in accordance with the second embodiment, when the thermal head is away from the platen roller.
Figure 13:
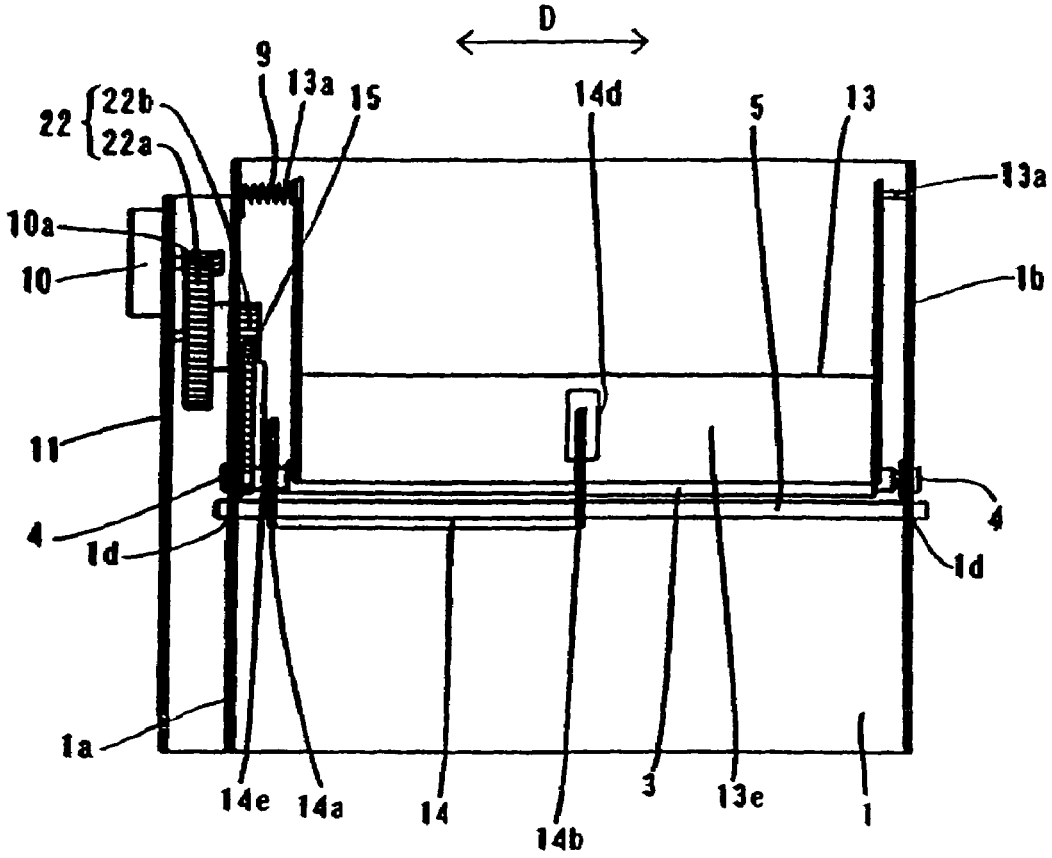
FIG. 13 is a plan view of the thermal transfer printer in accordance with the second embodiment.

FIG. 11 is an oblique view of the overall structure of the thermal transfer printer according to the second embodiment of the present invention. FIGS. 12 and 13 are a front view and a plan view of the thermal transfer printer of the second embodiment shown in FIG. 11. FIGS. 14 to 17 are diagrams of detailed structure of the thermal transfer printer of the second embodiment shown in FIG. 11. FIGS. 18 to 21 are diagrams illustrating how the thermal head presses on the platen roller with the thermal transfer printer of the second embodiment shown in FIG. 11. This second embodiment differs from the first embodiment in that it uses a cam mechanism to pivot the rotary member. The thermal head in this second embodiment is the same as that in the first embodiment except for the structure of the rotary member and the drive gear, and therefore will not be described in detail herein.

Figure 17:
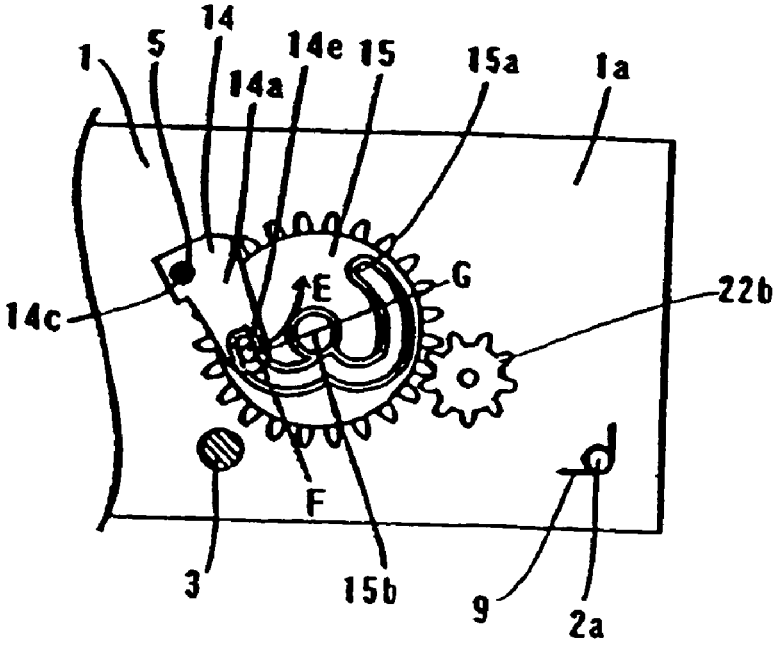
FIG. 17 is a schematic view of the detailed structure of the rotary member and the drive gear in accordance with the second embodiment.

As shown in FIGS. 11 and 17, with the thermal transfer printer according to the second embodiment, a thermal head 13 is attached so as to be pivotable around a support shaft 13*a* on the inside of the side surfaces of the frame 1. A head component 13*b* provided to the lower part of the thermal head 13 is disposed across from the platen roller 3 as shown in FIG. 11.

Figure 14:
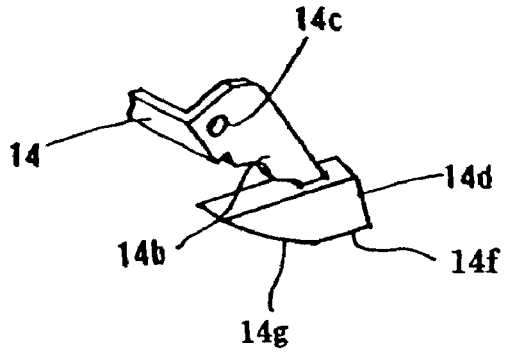
FIG. 14 is a partial oblique view of the rotary member of the thermal transfer printer in accordance with the second embodiment.

As shown in FIG. 11, a rotary member 14 is formed with a U-shape and includes a first side surface 14*a* and a second side surface 14*b* which is provided with a pressing member 14*d*. Holes 14*c* for attaching the elastically bendable support rod 5 are provided in the first side surface 14*a* and the second side surface 14*b* of the rotary member 14. The pressing member 14*d* has a bottom surface having a curved portion 14*g* and a flat portion 14*f*. Before the pressing operation, the tip end of the curved portion 14*g* of the pressing member 14*d* is in contact with the upper surface 13*e* of the thermal head 13. As the pressing operation starts, the portion of the pressing member 14*d* that presses the thermal head 13 shifts toward the flat portion 14*f*. When the pressing member 14*d* applies pressure to the thermal head 13 with the maximum pressure, the pressing member 14*d* presses the thermal head 13 with the flat portion 14*f*, as shown in FIGS. 11 and 14. A cam pin 14*e* is provided to the first side surface 14*a* of the rotary member 14 so as to engage with a cam groove 15*a* of a drive cam 15.

The height h3 (another example of the first distance, shown in FIG. 21), which is the height from the bottom of the flat portion 14*f* of the pressing member 14*d* to the center of the hole 14*c* on the second side surface 14*b* of the rotary member 14, is set to be approximately 3 mm greater than the height h4 (another example of the second distance, shown in FIG. 18), which is the height from the top surface 13*e* of the thermal head 13 when the thermal head 13 is closest to the platen roller 3 to the center of the insertion hole 1*d* in the frame 1. Thus, the support rod 5 is elastically bent upward by approximately 3 mm while the pressing member 14*d* is pressing on the thermal head 13 with the flat portion 14*f*.

Figure 18:
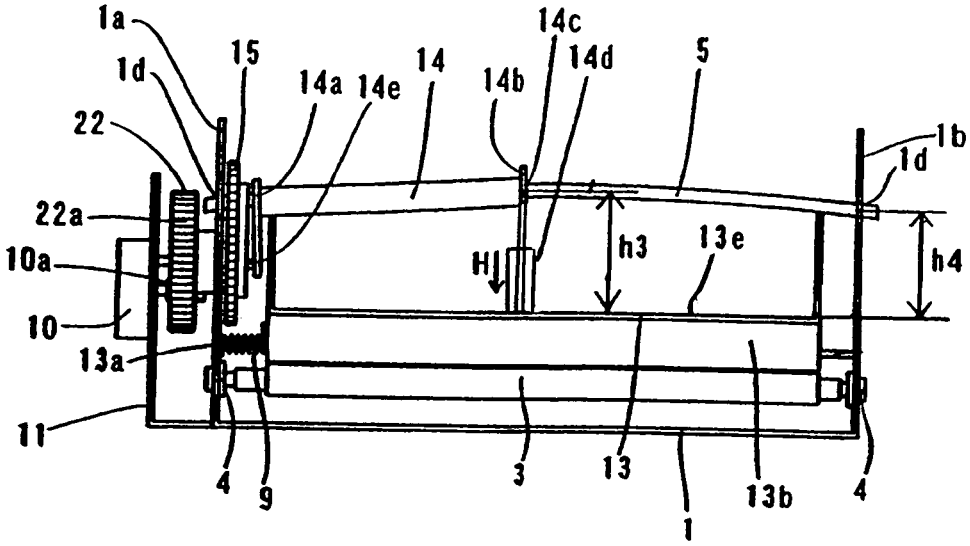
FIG. 18 is a front view of the thermal transfer printer in accordance with the second embodiment, when the rotary member is pressing against the thermal head.
Figure 19:
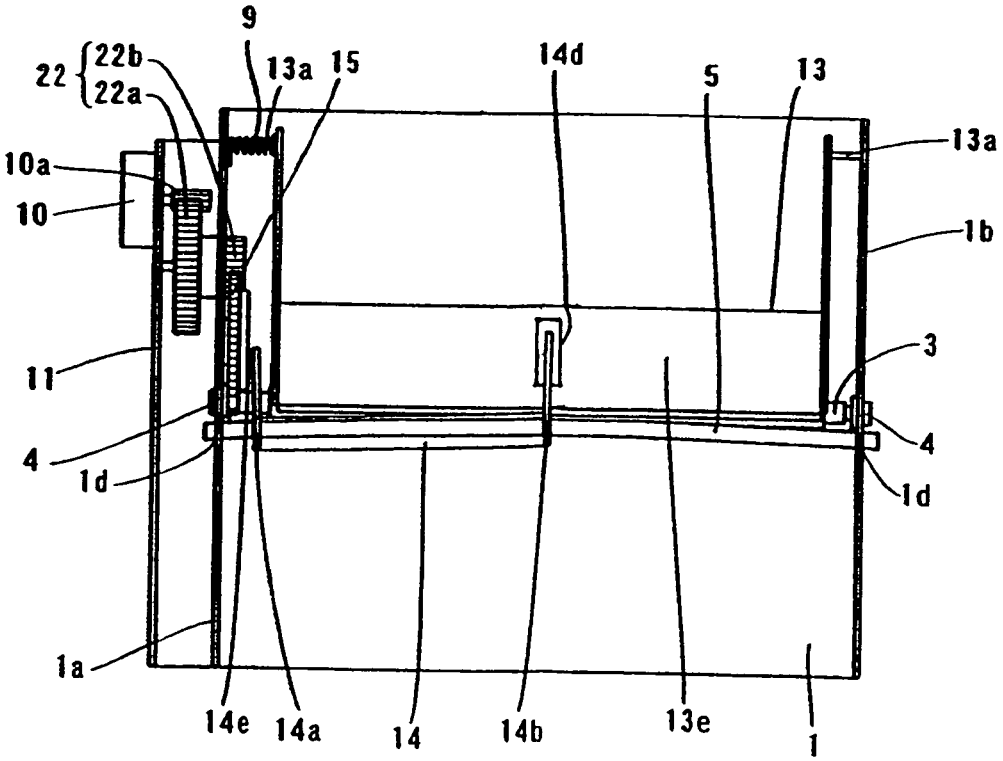
FIG. 19 is a plan view of the thermal transfer printer in accordance with the second embodiment, when the thermal head presses against the platen roller.
Figure 20:
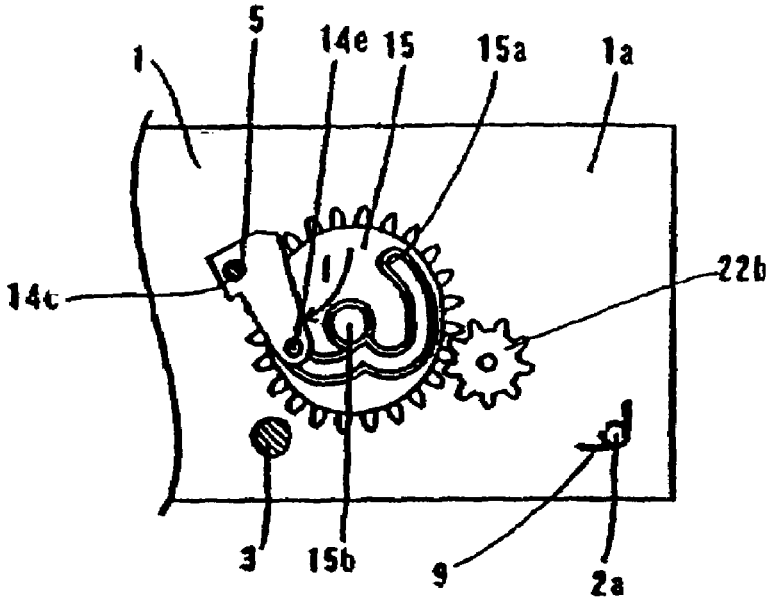
FIG. 20 is a schematic view of the positional relationship between the rotary member and the drive gear in accordance with the second embodiment.
Figure 21:
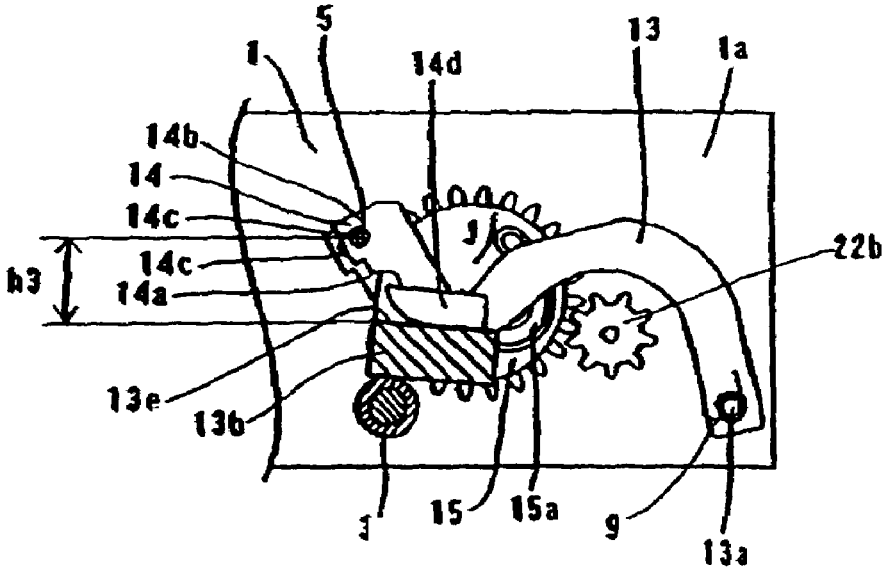
FIG. 21 is a schematic view of the positional relationship between the thermal head and the rotary member in accordance with the second embodiment, when the thermal head presses against the platen roller.
Figure 22:
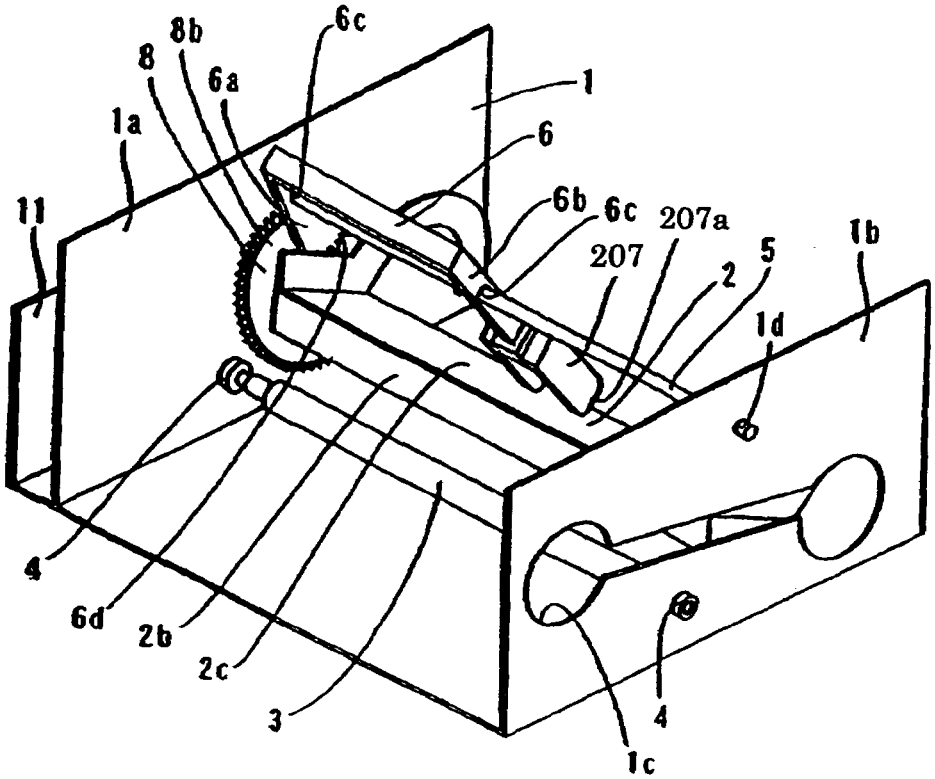
FIG. 22 is an oblique view of the overall structure of the thermal transfer printer in accordance with the other embodiment (d) of the present invention.
Figure 23:
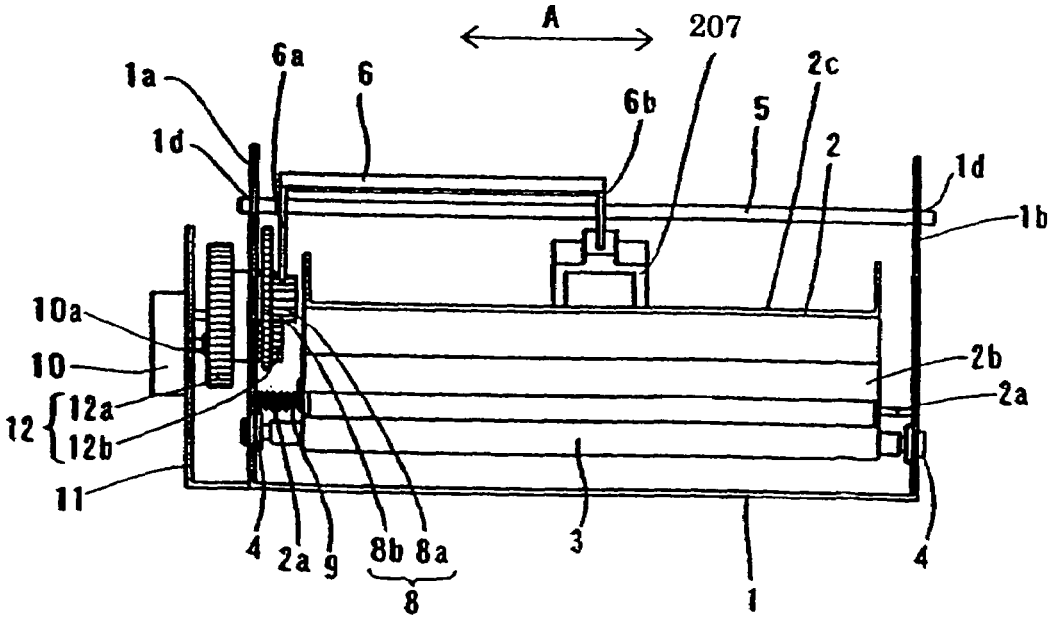
FIG. 23 is a front view of the thermal transfer printer in accordance with the other embodiment (d)
Figure 24:
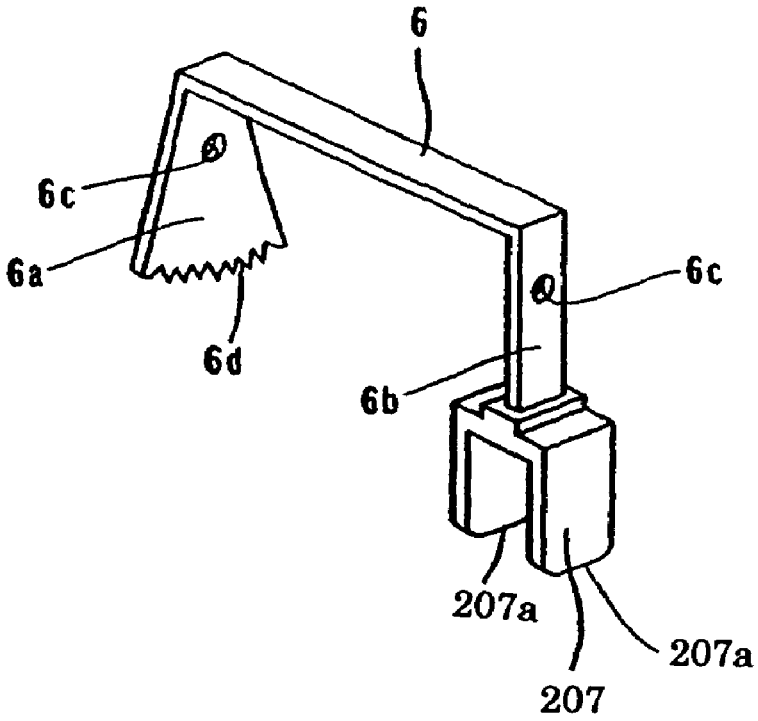
FIG. 24 is an oblique view of the structure of the rotary member of the thermal transfer printer in accordance with the other embodiment (d)
Figure 25:
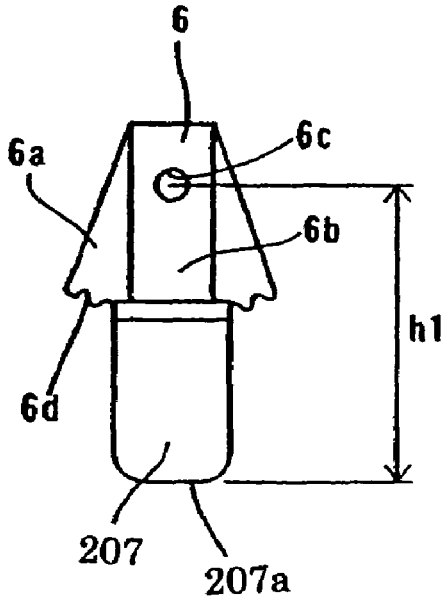
FIG. 25 is a front view of the structure of the rotary member of the thermal transfer printer in accordance with the other embodiment (d)
Figure 26:
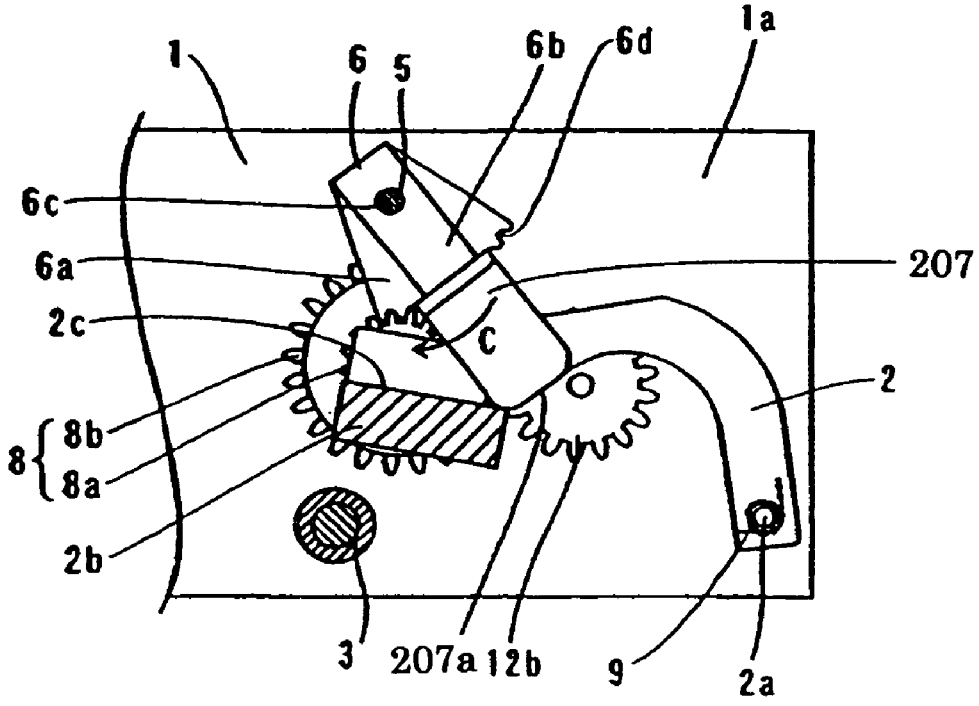
FIG. 26 is a schematic view of the positional relationship between the thermal head and the rotary member of the thermal transfer printer in accordance with the other embodiment (d), when the thermal head is away from the platen roller.
Figure 27:
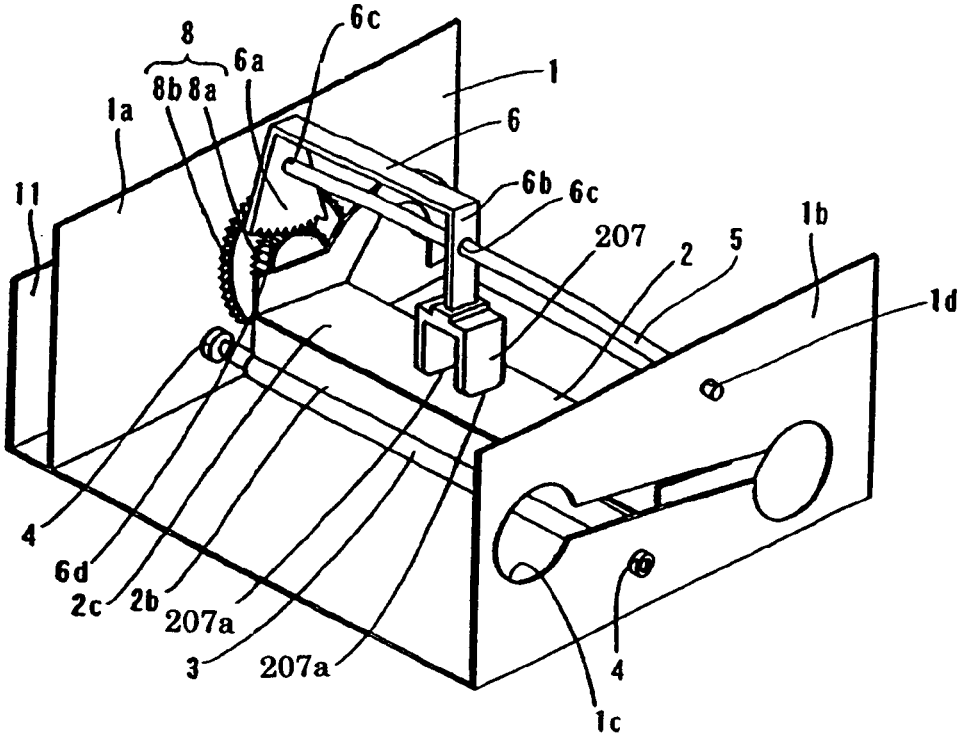
FIG. 27 is an oblique view of the overall structure of the thermal transfer printer in accordance with the other embodiment (d), when the rotary member is pressing against the thermal head.
Figure 28:
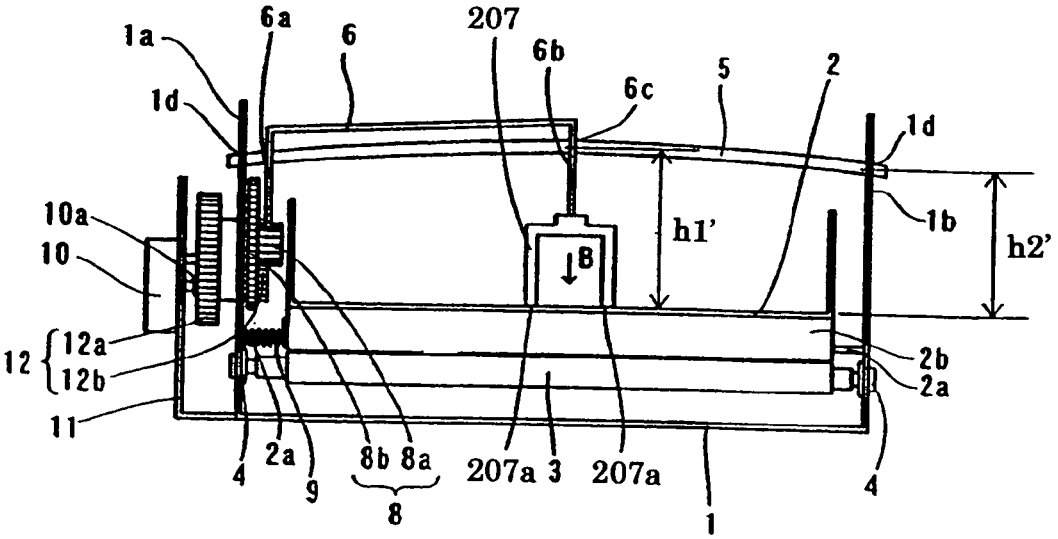
FIG. 28 is a front view of the thermal transfer printer in accordance with the other embodiment (d), when the rotary member is pressing against the thermal head.
Figure 29:
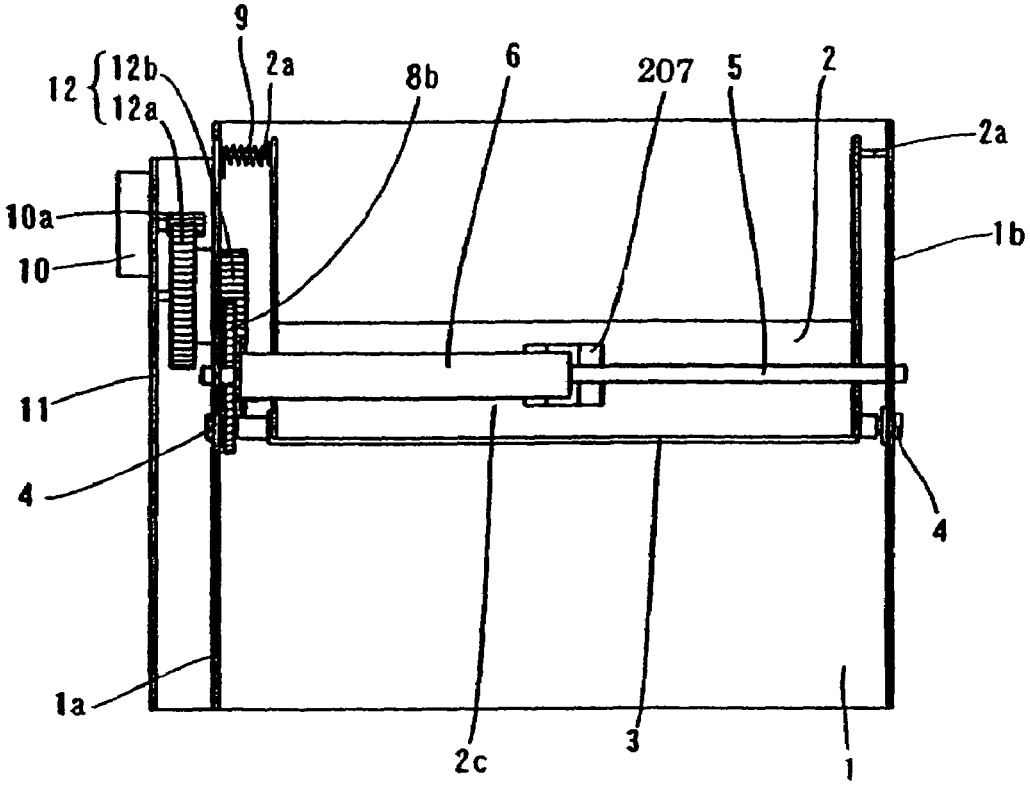
FIG. 29 is a plan view of the thermal transfer printer in accordance with the other embodiment (d), when the rotary member is pressing against the thermal head.
Figure 30:
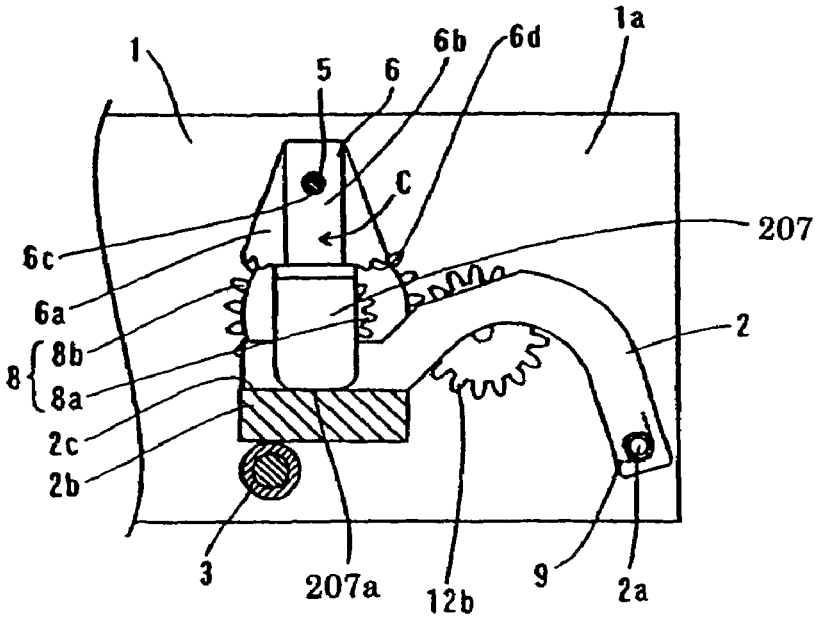
FIG. 30 is a schematic view of the positional relationship between the thermal head and the rotary member in accordance with the other embodiment (d), when the rotary member is pressing against the thermal head.
Figure 31:
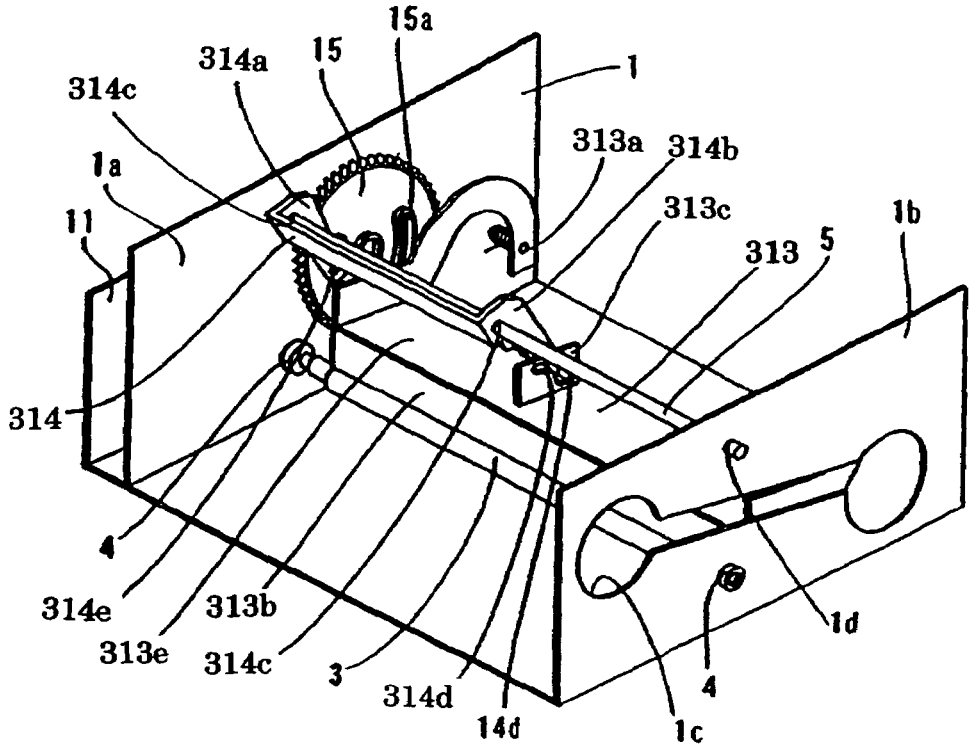
FIG. 31 is an oblique view of the overall structure of the thermal transfer printer in accordance with the other embodiment (e) of the present invention.

As seen in FIGS. 18-19, the second side surface 14*b* of the rotary member 14 is positioned approximately at the center of the support rod 5. Accordingly, the pressing member 14*d* is positioned to press the thermal head 13 at approximately the width-direction center of the thermal head 13.

Figure 15:
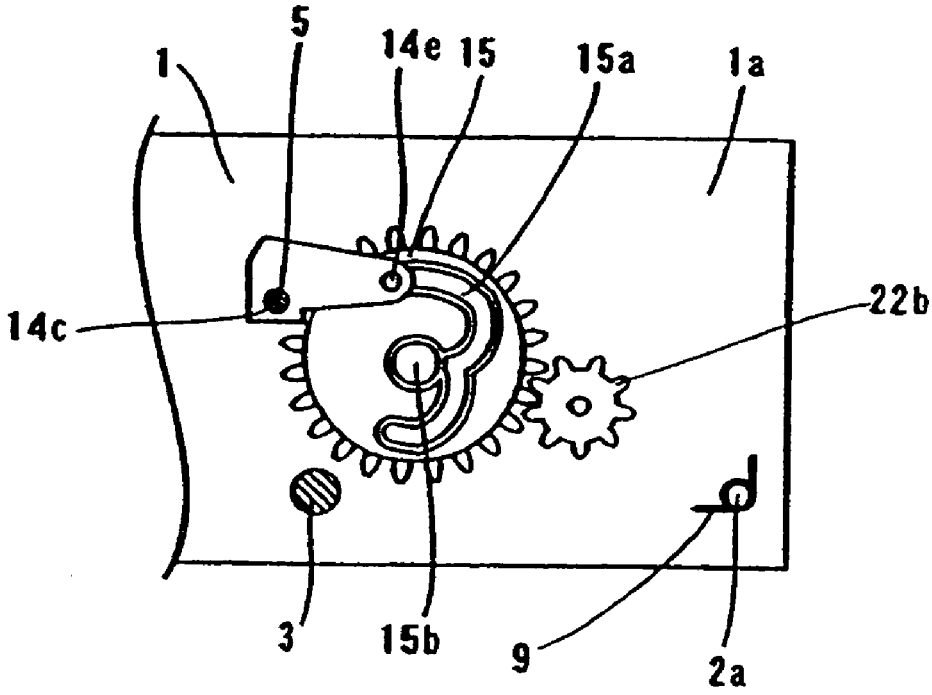
FIG. 15 is schematic view of the attachment structure of the rotary member and drive gear in accordance with the second embodiment.
Figure 16:
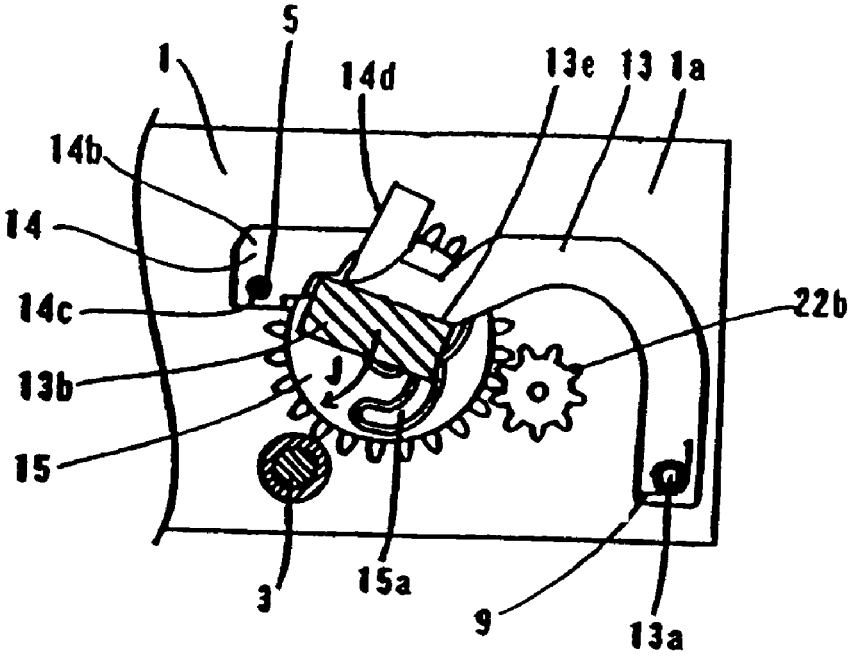
FIG. 16 is a schematic view of the positional relationship between the thermal head and the rotary member in accordance with the second embodiment, when the thermal head is away from the platen roller.

Also, as shown in FIG. 13, a drive gear 15 is attached to the first surface 1*a* of the frame 1 and engaged with a small-diameter gear 22*b* of an intermediate gear 22. As shown in FIG. 15, the cam groove 15*a* which engages the cam pin 14*e* of the first side surface 14*a* of the rotary member 14 is formed on the side surface of the drive gear 15. The drive gear 15 and the cam groove 15*a* are another example of the "drive mechanism" of the present invention. As shown in FIG. 17, the cam groove 15*a* is formed such that the pivoting direction (the direction of arrow E) in which the reaction force that is applied from the thermal head 13 to the pressing member 14*d* causes the first side surface 14*a* to pivot around the support rod 5 during the pressing operation is perpendicular to the plane (plane F), which is a tangential plane of the cam groove 15*a* at the point where the cam pin 14*e* comes into contact with the cam groove 15*a*. The rotational center 15*b* of the drive gear 15 is disposed on a line G, which is the tangential line of the arrow E. In other words, the direction in which the cam pin 14*e* rotates around the support rod 5 is the direction toward the rotational center 15*b* of the drive gear 15.

Next, the manner in which the thermal head 13 of the thermal transfer printer of the thermal transfer printer presses on the platen roller 3 in this second embodiment of the present invention will be described through reference to FIGS. 11 to 16 and FIGS. 17 to 21. First, in the initial state, as shown in FIGS. 11 to 16, the biasing force of the torsion coil spring 9 is causing the thermal head 13 to stay away from the platen roller 3, and the rotary member 14 to pivot to a position where the pressing member 14*d* does not press on the thermal head 13.

In this state, the drive force of the motor 10 (see FIG. 13) is transmitted from the motor shaft gear 10*a* to the first side surface 14*a* of the rotary member 14, through a large-diameter gear 22*a* and a small-diameter gear 22*b* of an intermediate gear 22, the drive gear 15, and the cam pin 14*e* of the rotary member 14 that engages with the cam groove 15*a* of the drive gear 15. As a result, the first side surface 14*a* of the rotary member 14 pivots from the state shown in FIG. 15 to the state shown in FIG. 20 in the direction of arrow I in FIG. 20. Accordingly, the second side surface 14*b* of the rotary member 14 also pivots in the direction of arrow J in FIG. 16, from the state shown in FIG. 16 to the state shown in FIG. 21.

Consequently, the pressing member 14*d* starts pressing the thermal head 13 with the flat portion 14*f*. Here, since the height h3 from the bottom of the flat portion 14*f* of the pressing member 14*d* to the center of the hole 14*c* on the second side surface 14*b* of the rotary member 14 is set to be approximately 3 mm greater than the height h4, which is the height from the top surface 13*e* of the thermal head 13 when the thermal head 13 is closest to the platen roller 3 to the center of the insertion hole 1*d* in the frame 1, the support rod 5, which is a piano wire with a diameter of approximately 3 mm, is elastically bent upward by approximately 3 mm during the pressing operation of the pressing member 14*d*. This generates flexural stress of about 30 to 40 N in the support rod 5, and this flexural stress causes the pressing member 14*d* to press against the upper surface 13*e* of the thermal head 13 in the direction of arrow H (see FIG. 18). As a result, the head component 13*b* of the thermal head 13 is pressed against the platen roller 3 at a pressing force of approximately 30 to 40 N.

In the second embodiment, as discussed above, the cam groove 15*a* is formed in the drive gear 15, and the cam pin 14*e* that engages with the cam groove 15*a* is provided in the first side surface 14*a* of the rotary member 14. In this manner, the drive force of the drive gear 15 is transmitted to the rotary member 14 using the cam groove 15*a* and the cam pin 14*e*, so that the pressing member 14*d* of the second side surface 14*b* of the rotary member 14 can easily pivot.

Also, in the second embodiment, the cam groove 15*a* is formed such that the direction in which the reaction force applied from the thermal head 13 to the pressing member 14*d* during the pressing operation pivots the first side surface 14*a* around the support rod 5 (the direction of arrow E in FIG. 17) is perpendicular to the plane F, which is a tangential plane of the cam groove 15*a* at the point where the cam pin 14*e* comes into contact with the cam groove 15*a*. Also, the rotational center 15*b* of the drive gear 15 is disposed on the line G, which is tangential to the arrow E. Since the direction in which the cam pin 14*e* rotates around the support rod 5 is the direction toward the rotational center 15*b* of the drive gear 15, even though the contact position between the thermal head 13 and the pressing member 14*d* of the second side surface 14*b* of the rotary member 14 is not directly beneath the support rod 5, the reaction force from the thermal head 13 to the pressing member 14*d* generated during the pressing operation does not pivot the first side surface 14*a* or second side surface 14*b* of the rotary member 14. Accordingly, there is no need for the contact position between the thermal head 13 and the second side surface 14*b* of the rotary member 14 to be disposed directly beneath the support rod 5. As a result, there are fewer restrictions imposed on the design of the thermal transfer printer according to the second embodiment. Thus, a greater degree of freedom is accorded in the design of the thermal transfer printer.

The other effects of the second embodiment of the present invention are the same as those of the first embodiment.

The embodiments disclosed here are in all respects examples, and should not be construed as a limitation to the scope of the invention. The scope of the present invention is defined by the claims, and not limited by the above descriptions of embodiments, and furthermore encompasses all modifications within a scope and meaning equivalent to the claims.

Other Embodiments (a) In the above embodiments, a thermal transfer printer is given as an example of the image forming apparatus. However, the present invention is not limited to thermal transfer printers, and can also be applied to other kinds of image forming apparatus besides a thermal transfer printer, as long as the image forming apparatus has a printing head.

(b) Also, in the above embodiments, the pressing members that press on the thermal head at near its width direction center. However, the present invention is not limited to such construction. The pressing member may press on any other portion other than the width direction center of the thermal head.

(c) Also, the above embodiments use as an example the flexural stress produced by the bending of the support rod to press on the thermal head with the pressing member. However, the present invention is not limited to such construction. The rotary member may be constituted by a leaf spring or other such member that can be twisted easily. In such cases the pressing member may be made to press against the thermal head by using both the torsional stress of the leaf spring and the flexural stress produced by the bending of the support rod.

(d) Also, in the first embodiment, the thermal transfer printer has the lower part of the pressing member that has one distal end. However, the present invention is not limited to such construction. For example, the lower part of the pressing member can be formed into two branches, as shown in FIGS. 22-30. In this case, the pressing member 207 has two pressing surfaces 207*a* that press the thermal head 3 as the toothed portion 6*d* of the first side surface 6*a* of the rotary member 6 engages the drive gear 8 and the second surface 6*b* pivots from the state shown in FIGS. 22 and 26 to the state shown in FIGS. 27 and 30. Other structure of the thermal transfer printer according to this embodiment is the same as that the first embodiment. Therefore, further detailed explanation will be omitted herein.

Furthermore, the lower part of the pressing member can be divided into three or more branches.

Figure 32:
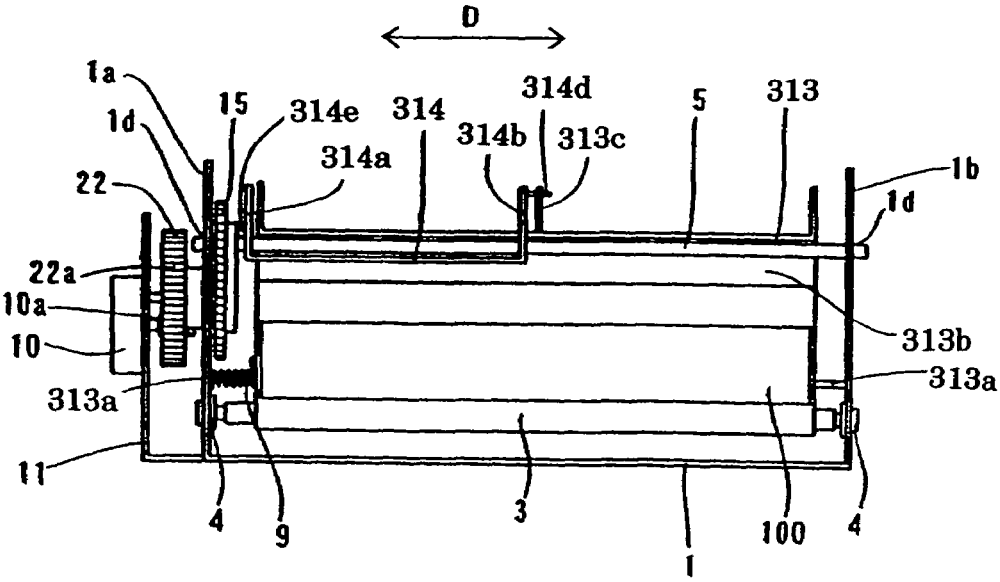
FIG. 32 is a front view of the thermal transfer printer in accordance with the other embodiment (e), when the thermal head is away from the platen roller.
Figure 33:
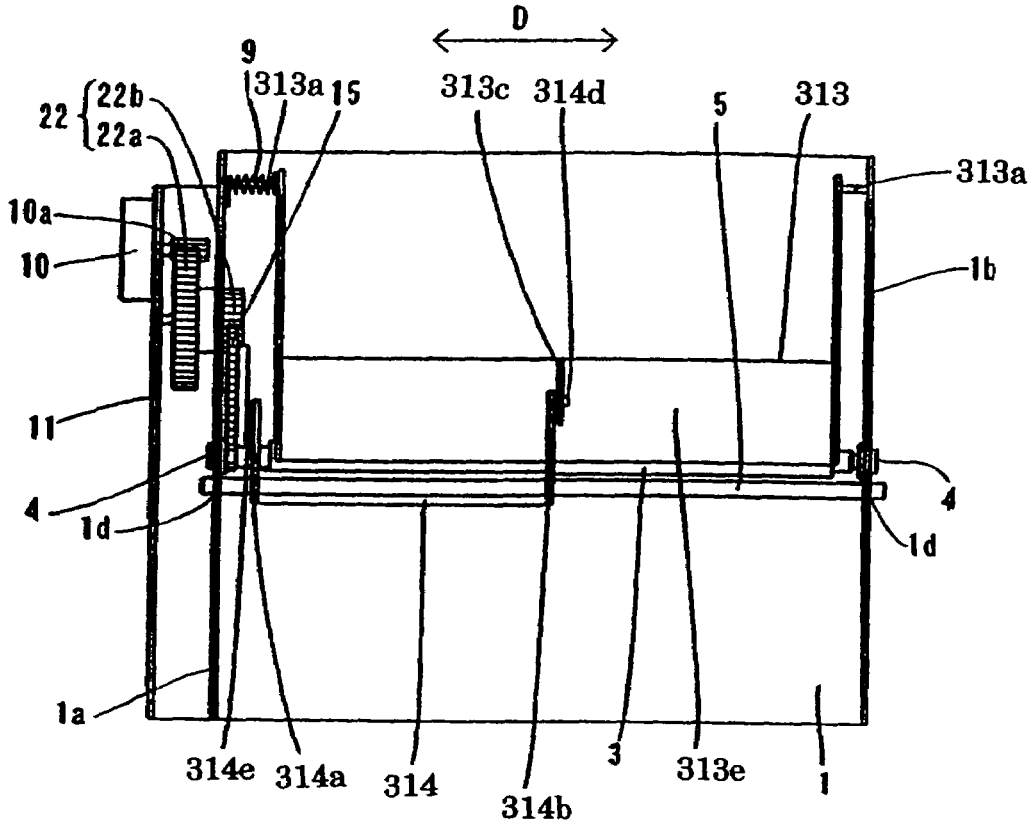
FIG. 33 is a plan view of the thermal transfer printer in accordance with the other embodiment (e), when the thermal head is away from the platen roller.
Figure 34:
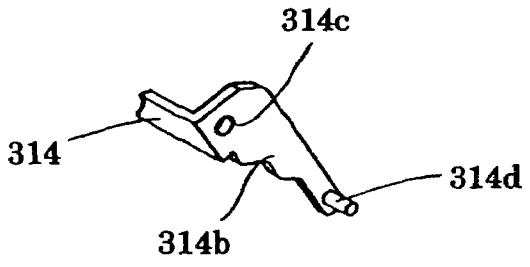
FIG. 34 is a partial oblique view of the rotary member of the thermal transfer printer in accordance with the other embodiment (e)
Figure 35:
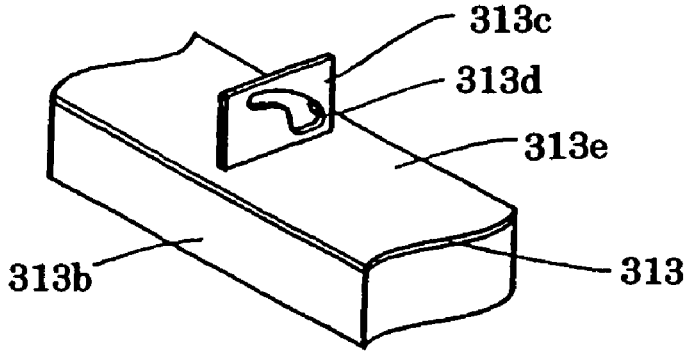
FIG. 35 is a partial oblique view of the thermal head in accordance with the other embodiment (e)
Figure 36:
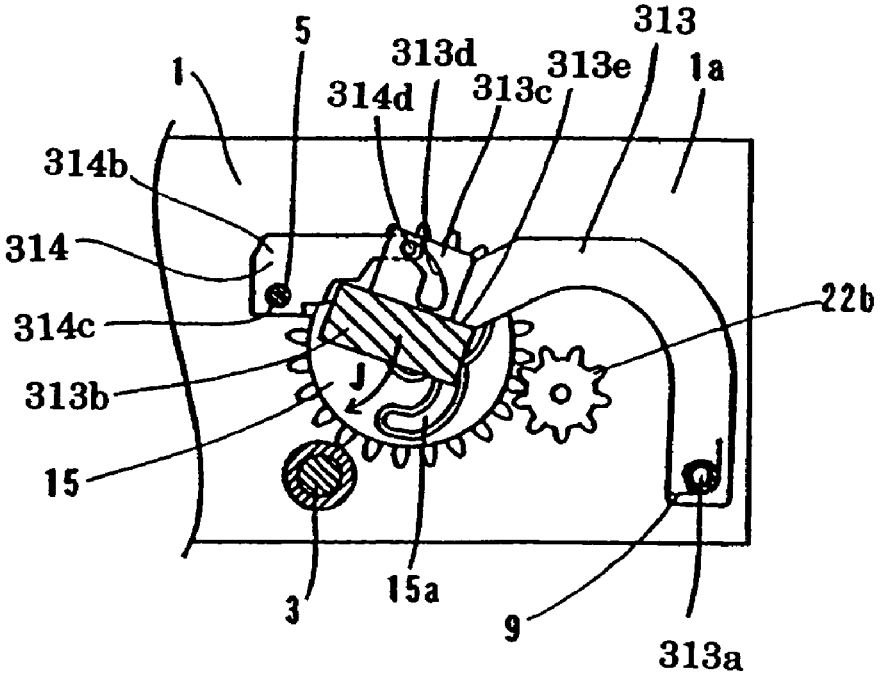
FIG. 36 is a schematic view of the positional relationship between the thermal head and the rotary member in accordance with the other embodiment (e), when the thermal head is away from the platen roller.
Figure 37:
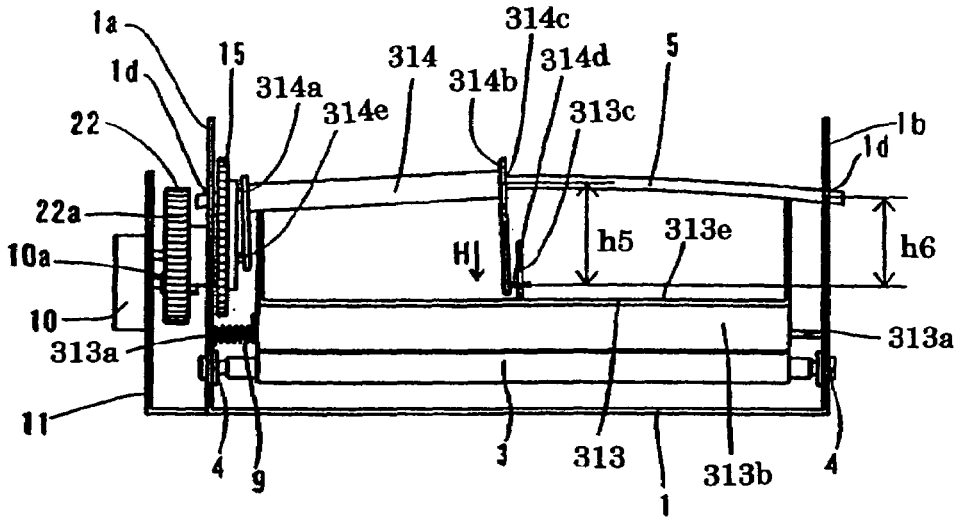
FIG. 37 is a front view of the thermal transfer printer in accordance with the other embodiment (e), when the rotary member is pressing against the thermal head.
Figure 38:
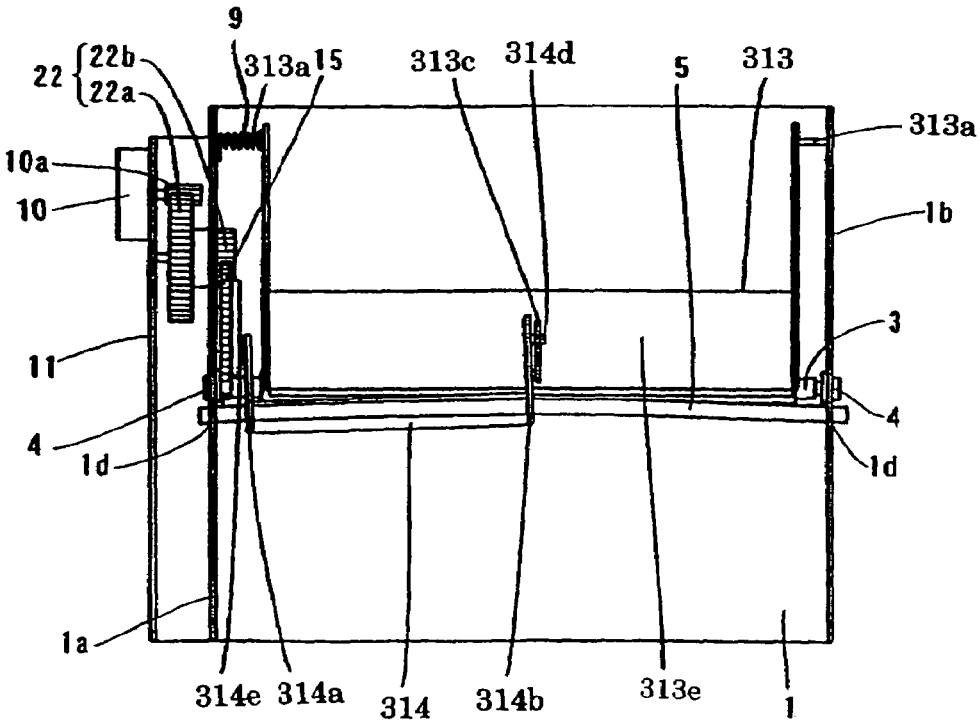
FIG. 38 is a plan view of the thermal transfer printer in accordance with the other embodiment (e), when the thermal head presses against the platen roller.
Figure 39:
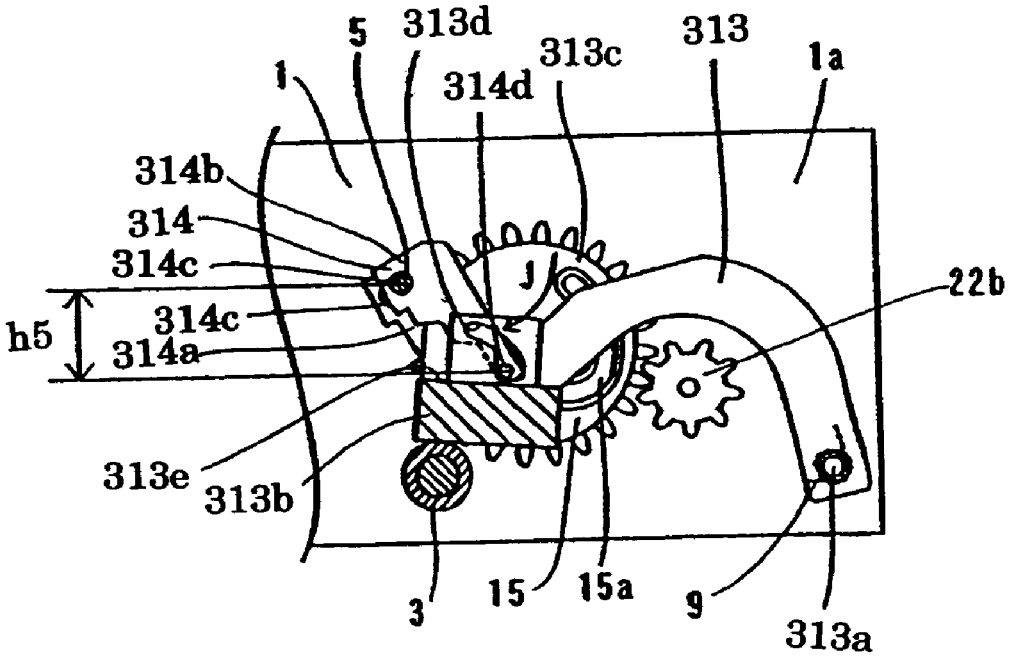
FIG. 39 is a schematic view of the positional relationship between the thermal head and the rotary member in accordance with the other embodiment (e), when the thermal head presses against the platen roller.
Figure 40:
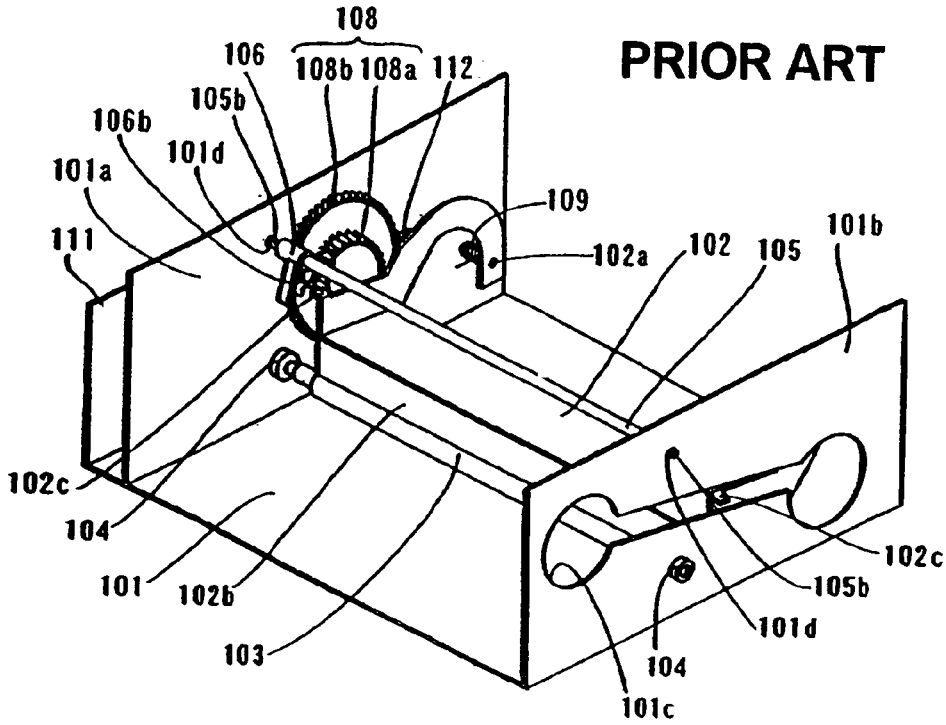
FIG. 40 is an oblique view of the overall structure of a conventional thermal transfer printer.
Figure 41:
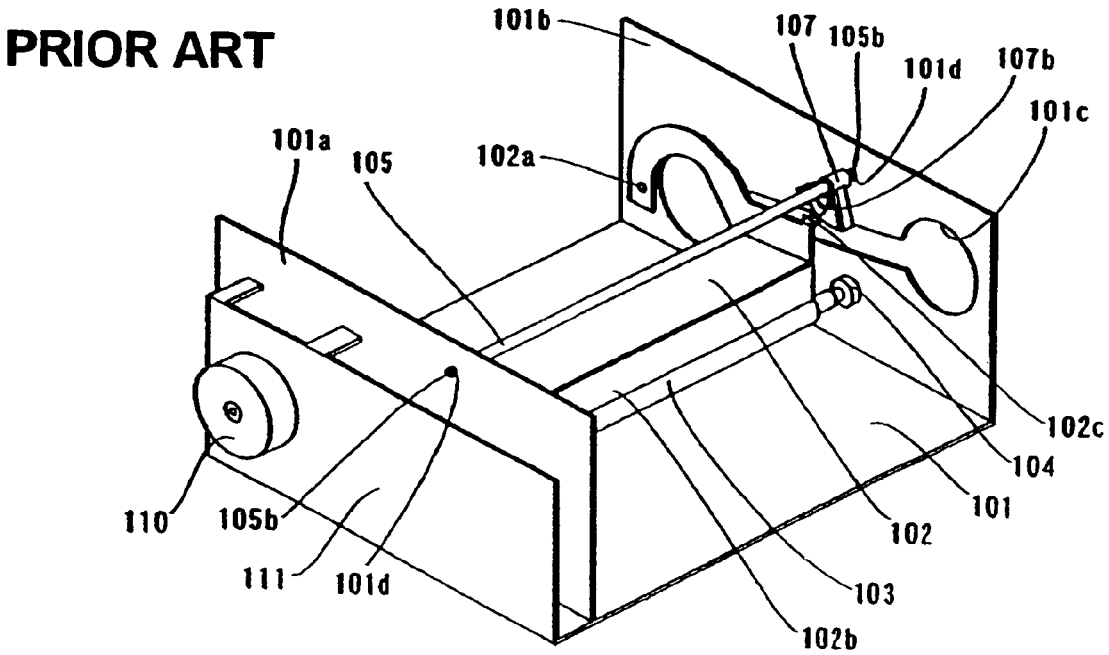
FIG. 41 is another oblique view of the overall structure of the conventional thermal transfer printer shown in FIG. 40.
Figure 42:
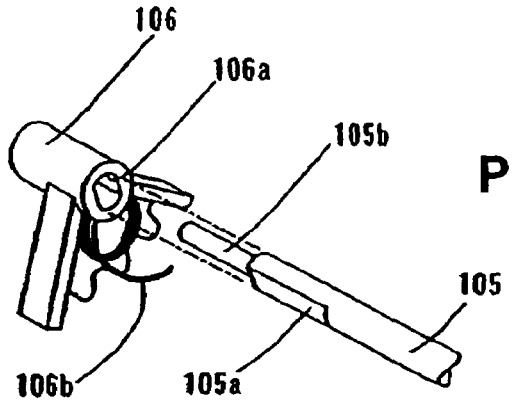
FIG. 42 is an oblique view of the attachment structure of the shaft and the pressing member of the conventional thermal transfer printer shown in FIGS. 40 and 41.
Figure 43:
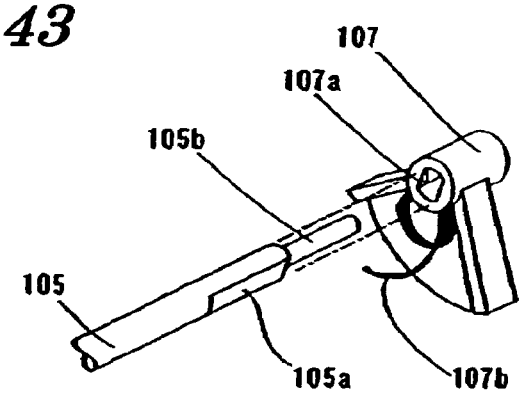
PRIOR ART Figure 43
FIG. 43 is an oblique view of the attachment structure of the shaft and the pressing member of the conventional thermal transfer printer shown in FIGS. 40 and 41.
Figure 44:
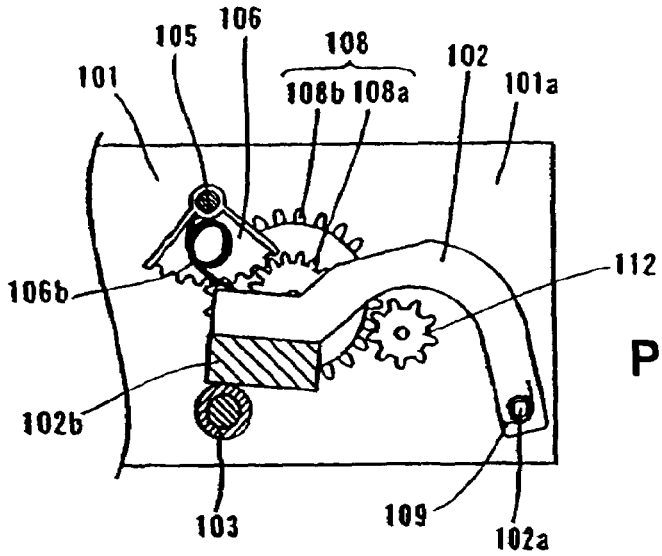
PRIOR ART Figure 44
FIG. 44 is a schematic view illustrating how the thermal head presses against the platen roller in the conventional thermal transfer printer shown in FIGS. 40 and 41.

(e) In the above embodiments, the torsion springs 9 are used to bring the thermal heads 2 and 13 away from the platen rollers 3 while the pressing members 7 and 14*d* are not pressing the thermal heads 2 and 13. However, the present invention is not limited to such construction. Instead, the present invention can have a structure shown in FIGS. 31-39, where the second side surface 314*b* is provided with a pressing pin 314*d* as shown in FIG. 34, and the thermal head 313 has an engagement portion 313*c* on its upper surface 313*e* as shown in FIG. 35, at approximately the center of the thermal head 313 in the width direction (the direction of arrow D in FIGS. 32-33). The engagement portion 313*c* has an engagement hole 313*d* as shown in FIG. 35, such that the second side surface 314*b* engages with the engagement portion 313*c* through the engagement of the pressing pin 314*d* with the engagement hole 313*d*. As shown in FIG. 36, the pressing pin 314*d* stays engaged with the upper portion of the engagement hole 313*d* when the pressing pin 314*d* is not pressing the thermal head 313. During the pressing operation, the pressing pin 314*d* strikes the lower portion of the engagement hole 313*d* of the engagement portion 313*c*, as shown in FIG. 39, and thereby presses the thermal head 313.

The height h5, (still another example of the first distance) which is the height from the center of the pressing pin 314*d* of the second side surface 314*b* to the center of the hole 314*c* of the rotary member 314, is set to be approximately 3 mm greater than the height h6 (still another example of the second distance, shown in FIG. 37), which is the height from the center of the pressing pin 314*d* of the second side surface 314*b* of the rotary member 314 to the center of the insertion holes 1*d* in the frame 1. Thus, the support rod 5, which is a piano wire with a diameter of approximately 3 mm, is elastically bent upward by approximately 3 mm while the pressing pin 314*d* is in engagement with the lower portion of the engagement hole 313*d* and pressing on the thermal head 313. The structure of the drive gear 15, the cam groove 15*a*, and the first side surface 314*a* is the same as that of the drive gear 15, the cam groove 15*a*, and the first side surface 14*a* of the second embodiment. Therefore, their detailed explanation will be omitted herein.

(f) Also, in the above embodiments, the pressing members 7 and 14*d* are formed separately from the second side surfaces 6*b* and 206*b*. However, the present invention is not limited to such construction. Instead, the pressing member may be constituted integrally with the second side surface of the rotary member.

As used herein, the following directional terms "forward, rearward, above, downward, vertical, horizontal, below and transverse" as well as any other similar directional terms refer to those directions of a device equipped with the present invention. Accordingly, these terms, as utilized to describe the present invention should be interpreted relative to a device equipped with the present invention.

The term "configured" as used herein to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

This application claims priority to Japanese Patent Application No. 2004-117988. The entire disclosure of Japanese Patent Application No. 2004-117988 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. An image forming apparatus comprising:

a frame;

a head portion pivotably supported on the frame;

a platen roller rotatably supported on the frame opposite the head portion;

an elastically deformable support rod supported on the frame;

a rotary member rotatably supported with respect to the support rod and having a pressing member, the pressing member being adapted to press the head portion against the platen roller with an urging force of the support rod; and a drive mechanism engaged with the rotary member to pivot the rotary member around the support rod.

2. An image forming apparatus comprising:

a frame;

a head portion pivotably supported on the frame;

a platen roller rotatably supported on the frame opposite the head portion;

an elastically deformable support rod supported on the frame;

a rotary member rotatably supported with respect to the support rod and having a pressing member, the pressing member being adapted to press the head portion against the platen roller with an urging force of the support rod, the pressing member being positioned between the support rod and the head portion when the pressing member presses the head portion against the platen roller with the urging force of the support rod; and a drive mechanism engaged with the rotary member to pivot the rotary member around the support rod.

3. An image forming apparatus comprising a frame;

a head portion pivotably supported on the frame;

a platen roller rotatably supported on the frame opposite the head portion;

an elastically deformable support rod supported on the frame;

a rotary member pivotably supported by the support rod and having a pressing member, the pressing member being adapted to press the head portion against the platen roller with an urging force of the support rod, the pressing member having a flat bottom surface that comes into contact with the head portion; and a drive mechanism engaged with the rotary member to pivot the rotary member around the support rod.

4. The image forming apparatus according to claim 1, wherein the drive mechanism has a drive gear, and the rotary member has a toothed portion that engages with the drive gear.

5. An image forming apparatus comprising:

a frame;

a head portion pivotably supported on the frame;

a platen roller rotatably supported on the frame opposite the head portion;

an elastically deformable support rod supported on the frame;

a rotary member pivotably supported by the support rod and having a pressing member, the pressing member being adapted to press the head portion against the platen roller with an urging force of the support rod; and a drive mechanism engaged with the rotary member to pivot the rotary member around the support rod, the drive mechanism having a cam groove, the rotary member further having a cam pin that engages with the cam groove.

6. An image forming apparatus comprising:

a frame;

a head portion pivotably supported on the frame;

a platen roller rotatably supported on the frame opposite the head portion;

an elastically deformable support rod supported on the frame;

a rotary member pivotably supported by the support rod and having a pressing member, the pressing member being adapted to press the head portion against the platen roller with an urging force of the support rod at substantially a width direction center of the head portion; and a drive mechanism engaged with the rotary member to pivot the rotary member around the support rod.

7. An image forming apparatus comprising:

a frame;

a head portion pivotably supported on the frame;

a platen roller rotatably supported on the frame opposite the head portion;

an elastically deformable support rod supported on the frame;

a rotary member pivotably supported by the support rod and having a pressing member, the pressing member being adapted to press the head portion against the platen roller with an urging force of the support rod; and a drive mechanism engaged with the rotary member to pivot the rotary member around the support rod, the rotary member including a first side arm that engages the drive mechanism and a second side arm to which the pressing member is attached, each of the first and second side arms being rotatably supported by the support rod.

8. The image forming apparatus according to claim 1, wherein the head portion is a thermal head.

9. The image forming apparatus according to claim 1, wherein the support rod is made of a piano wire.

10. A thermal transfer printer, comprising:

a frame;

a thermal head pivotably supported on the frame and adapted to perform printing;

a platen roller rotatably supported on the frame opposite the thermal head;

an elastically deformable metal support rod supported on the frame;

a rotary member pivotably supported by the support rod and having first and second side arms and a pressing member that is attached to the second side arm and has a flat bottom surface, each of the first and second side arms being rotatably supported by the support rod; and a drive mechanism engaged with the first side arm of the rotary member to pivot the second side arm around the support rod, wherein a first distance between the fiat bottom surface of the pressing member and where the support rod supports the second side arm is longer than a second distance between where the support rod is supported on the frame and an upper surface of the thermal head when the thermal head is pivoted toward the platen roller the most.

11. The thermal transfer printer according to claim 10, wherein the drive mechanism has a drive gear, and the first side arm of the rotary member has a toothed portion that engages with the drive gear.

12. The thermal transfer printer according to claim 10, wherein the drive mechanism includes a cam groove, and the first side arm of the rotary member has a cam pin that engages with the cam groove.

13. The thermal transfer printer according to claim 10, wherein the pressing member presses the thermal head at substantially a width direction center of the thermal head.

* * * * *